US007743716B1

(12) United States Patent
Burka

(10) Patent No.: US 7,743,716 B1
(45) Date of Patent: Jun. 29, 2010

(54) ADJUSTABLE HEIGHT COUNTER TOP SYSTEM

(76) Inventor: Eric S. Burka, 815 Waterford Villas Dr., Lake St. Louis, MO (US) 63367

( * ) Notice: Subject to any disclaimer, the term of this patent is extended or adjusted under 35 U.S.C. 154(b) by 902 days.

(21) Appl. No.: 11/471,130

(22) Filed: Jun. 20, 2006

Related U.S. Application Data

(60) Provisional application No. 60/691,641, filed on Jun. 20, 2005.

(51) Int. Cl.
*A47B 9/00* (2006.01)

(52) U.S. Cl. ..... 108/147; 248/162.1; 248/406.2

(58) Field of Classification Search ..... 108/147, 108/106, 10, 147.11, 50.01, 50.02; 312/247, 312/312, 140.1, 319.8, 319.1, 349, 350; 248/188.5, 248/188.2, 162.1, 406.2
See application file for complete search history.

(56) References Cited

U.S. PATENT DOCUMENTS

| | | | | | |
|---|---|---|---|---|---|
| 3,472,219 | A | * | 10/1969 | Roy et al. | 312/312 |
| 3,502,384 | A | * | 3/1970 | Gipson | 312/312 |
| 4,009,918 | A | | 3/1977 | MacDonald et al. | 312/255 |
| 4,616,887 | A | * | 10/1986 | Oudman | 312/140.1 |
| 4,619,208 | A | * | 10/1986 | Kurrasch | 108/147 |
| 4,747,353 | A | * | 5/1988 | Watt | 108/147 |
| 4,969,403 | A | * | 11/1990 | Schwartz et al. | 108/147 |
| 4,981,085 | A | * | 1/1991 | Watt | 108/147 |
| 5,129,611 | A | * | 7/1992 | Grover et al. | 108/147 |
| 5,370,063 | A | * | 12/1994 | Childers | 108/147 |
| 5,400,721 | A | * | 3/1995 | Greene | 108/147 |
| 5,408,940 | A | * | 4/1995 | Winchell | 108/147 |
| 5,598,789 | A | * | 2/1997 | Jonker | 108/147 |
| 5,682,825 | A | * | 11/1997 | Manner | 108/147 |
| 5,819,669 | A | * | 10/1998 | Eyre | 108/147 |
| 5,867,847 | A | | 2/1999 | Klawitter et al. | 4/645 |
| 5,941,182 | A | * | 8/1999 | Greene | 108/147 |
| 6,026,755 | A | * | 2/2000 | Long | 108/147 |
| 6,062,148 | A | * | 5/2000 | Hodge et al. | 108/147 |
| 6,152,049 | A | * | 11/2000 | Schmidt | 108/147 |
| 6,213,575 | B1 | | 4/2001 | Brin, Jr. et al. | 312/140.1 |
| 6,286,441 | B1 | * | 9/2001 | Burdi et al. | 108/147 |
| 6,477,725 | B1 | | 11/2002 | Hong et al. | 4/645 |
| 6,546,880 | B2 | * | 4/2003 | Agee | 108/147 |
| 6,595,144 | B1 | * | 7/2003 | Doyle | 108/147 |
| 6,877,825 | B2 | * | 4/2005 | Khosropour et al. | 312/140.1 |
| 6,997,116 | B2 | * | 2/2006 | George et al. | 108/147 |
| 7,128,003 | B2 | * | 10/2006 | Okninski | 108/147 |
| 7,163,184 | B2 | * | 1/2007 | Nielsen | 108/147 |
| 2002/0145088 | A1 | * | 10/2002 | Santoro et al. | 248/188.2 |

* cited by examiner

*Primary Examiner*—José V Chen
(74) *Attorney, Agent, or Firm*—Grace J. Fishel

(57) ABSTRACT

A motorized elevator unit for adjusting the height of counter tops has right and left elevator assemblies under control of a primary control switch. Each elevator assembly includes top and bottom frames which may be formed from T-slotted framing with the top frame sliding vertically along the bottom frame on rollers received in the bottom frame. A movable counter top is mounted on the top frames and a motor drive assembly raises and lowers the top frames in unison. The elevator unit may be housed in a standard base cabinet and may be integrated with other standard base cabinets having stationary counter tops.

20 Claims, 33 Drawing Sheets

Fig. 8E
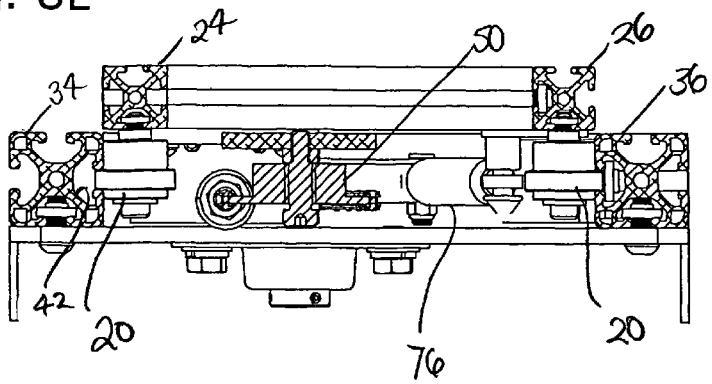
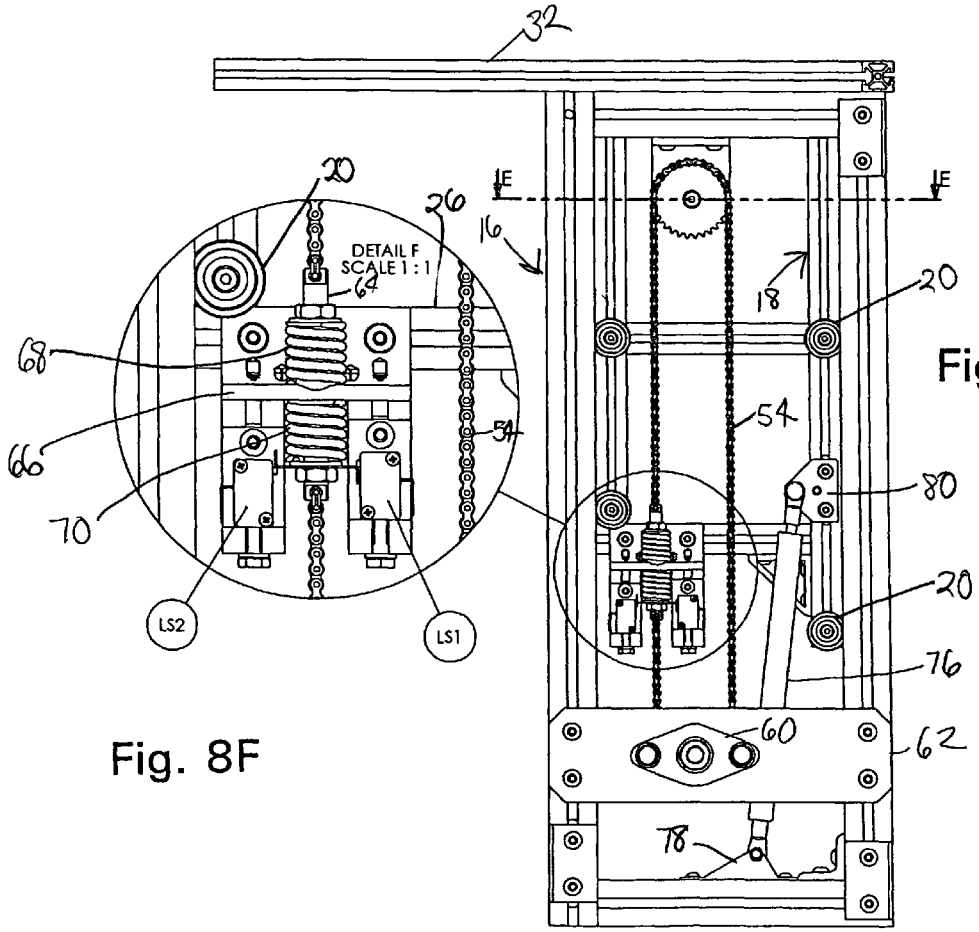
Fig. 8
Fig. 8F

Fig. 20
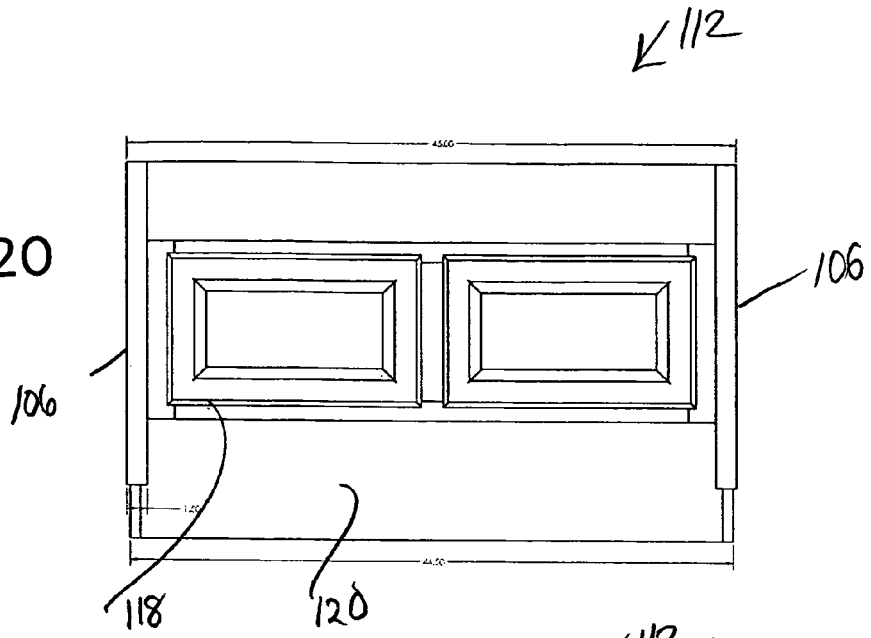
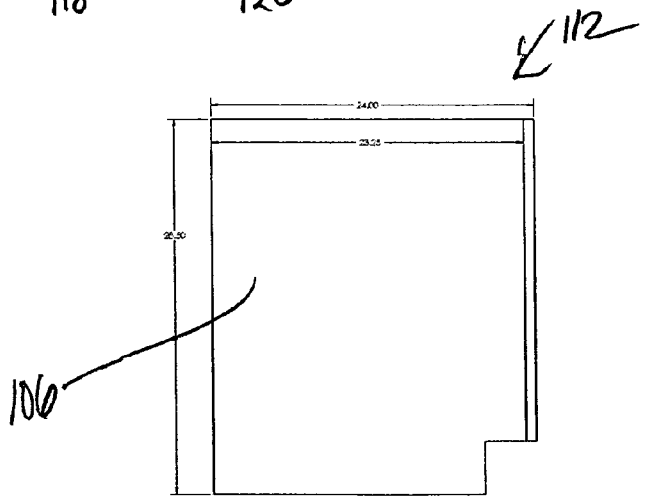
Fig. 21
Fig. 22
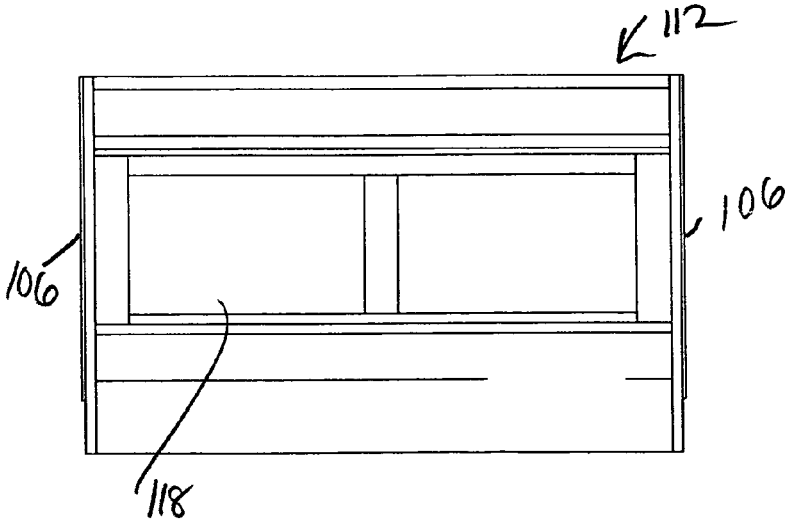

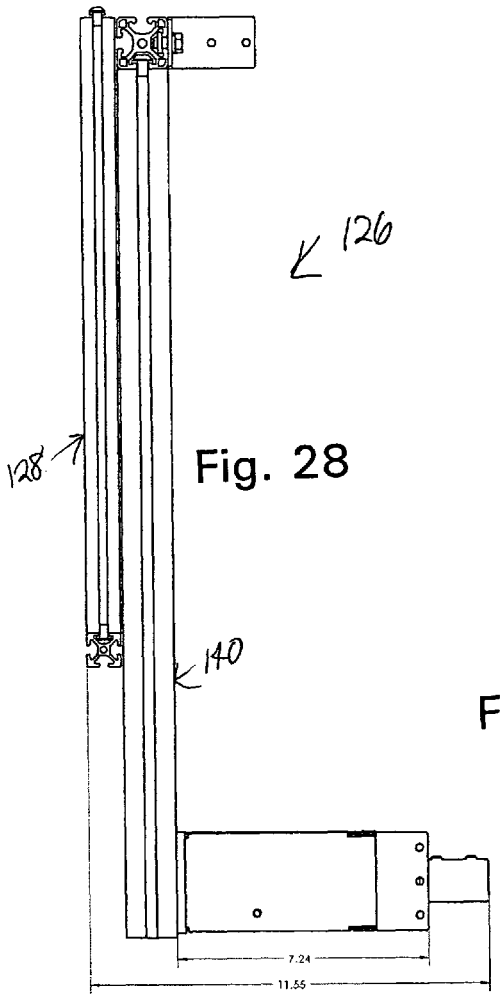
Fig. 28
Fig. 29
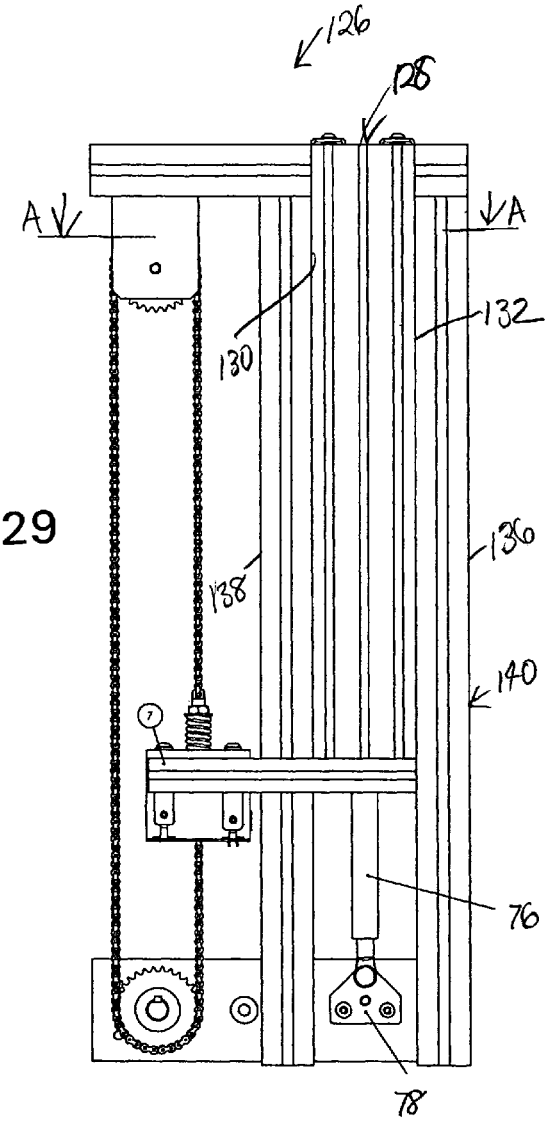

ADJUSTABLE HEIGHT COUNTER TOP SYSTEM

This application claims priority from provisional patent application Ser. No. 60/691,641, filed Jun. 20, 2005, for Adjustable Height Counter Top System for Kitchen and Baths.

BACKGROUND OF THE INVENTION

1. Field of the Invention

The present invention relates to a motorized elevator unit for adjusting the height of counter tops generally of kitchen or bathroom base cabinets. Also, the invention particularly relates to easy and seamless integration of cabinets with adjustable counter tops with conventional cabinetry and counter tops.

2. Brief Description of the Prior Art

The height of kitchen and bathroom counter tops and other work counter surfaces such as desks, benches and the like is determined according to industry standards in order to most conveniently accommodate the average person. While standard base cabinets and counters are convenient for an average, ambulatory person, access is difficult for one who is confined to a wheelchair.

The most common solution for kitchen and bathroom counter top accessibility is to permanently lower the counter top. The vast majority of handicapped people, however, live with one or more non-handicapped persons and the lowered counters are inconvenient for them. Accessibility should include everyone. Hence, it would be desirable to have an adjustable counter top system that allows, with a touch of a switch, for the counter to be lowered to wheelchair height or returned to standard cabinet height. For the aging and the handicapped, living independently with others for as long as possible is a goal.

There are systems for raising and lowering work counters which make use of telescoping legs. In these systems, a bottom portion is stationary and a top portion with the counter is raised and lowered. The base is telescopically received in a skirt of the movable top portion such that the cabinet appears to be a permanent fixture regardless of what height the top portion is set. These systems, however, do not integrate well with standard cabinets.

Hence, it would also be desirable to have an adjustable counter top system that can be installed in standard-sized base cabinets such that the cabinets with adjustable counter tops can be seamless integrated with conventional cabinetry and counter tops. This would permit installation of adjustable counter tops in kitchens and baths possibly pre-need in new construction or while renovating an existing home, as well as for retrofitting existing cabinets when a need develops.

BRIEF SUMMARY OF THE INVENTION

In view of the above, it is an object of the present invention to provide a motorized counter system that allows a user to adjust the counter up and down with a flip of a switch. It is another object to provide a motorized counter system that can be easily integrated with standard cabinets. Other objects and features of the invention will be in part apparent and in part pointed out hereinafter.

In accordance with the invention, an elevator unit is provided with left and right hand elevator assemblies connected by a common drive shaft that is connected to an electric motor. A base cabinet houses the elevator unit, provides for enclosure and some structural support.

Left and right hand interface frames, mounted to the top of the base cabinet sides, provide accommodation for attachment of adjacent stationary counter tops as well as for mounting a primary motor control switch and for housing the associated control wiring. A standard or custom movable counter top, suitable for application requirements, is attached to horizontal mounting bars connected to the top frames of the elevator unit. In the horizontal mounting bars, a lip seal may be integrated to contain liquid spills on the counter top. Alternatively, a drip tray connected to a drain may be provided along each side edge of the movable counter top.

The flexibility of the present invention allows for various base cabinet widths to suit industry standard dimensions, or custom widths, and accommodates counter tops with sinks, cook tops, ranges and the like installed. Also, the present invention allows for integration of adjacent cabinets and stationary counter tops on both sides or on either side with one of the sides being open ended and finished to suit. The invention also allows for construction of an independent island cabinet unit into which one or more elevator units may be integrated.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 8 is a elevational view of the left elevator assembly in down position viewed from the inside and showing a roller chain drive arrangement including a drive and driven sprocket;

FIG. 8E is a cross section taken along line E-E in FIG. 8 of the driven sprocket;

FIG. 8F is a detail from FIG. 8 showing a control unit for limiting elevator travel of the elevator unit;

FIG. 20 is a front elevational view of the base cabinet;

FIG. 21 is a left side elevational view of the base cabinet;

FIG. 22 is a back elevational view of the base cabinet;

FIG. 28 is a front elevational view of the left elevator assembly shown in FIG. 27;

FIG. 29 is a side elevational view of the left elevator assembly viewed from the outside;

DETAILED DESCRIPTION OF THE INVENTION

Figure 1:
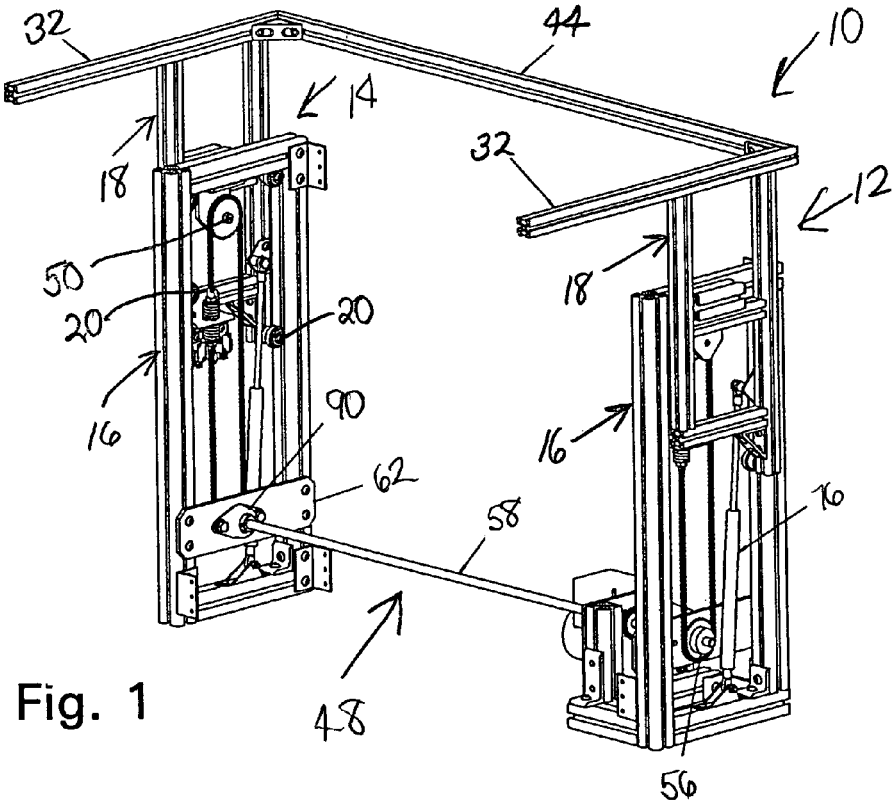
FIG. 1 is a perspective view of an elevator unit for a work counter in accordance with the present invention, shown in up position.
Figure 2:
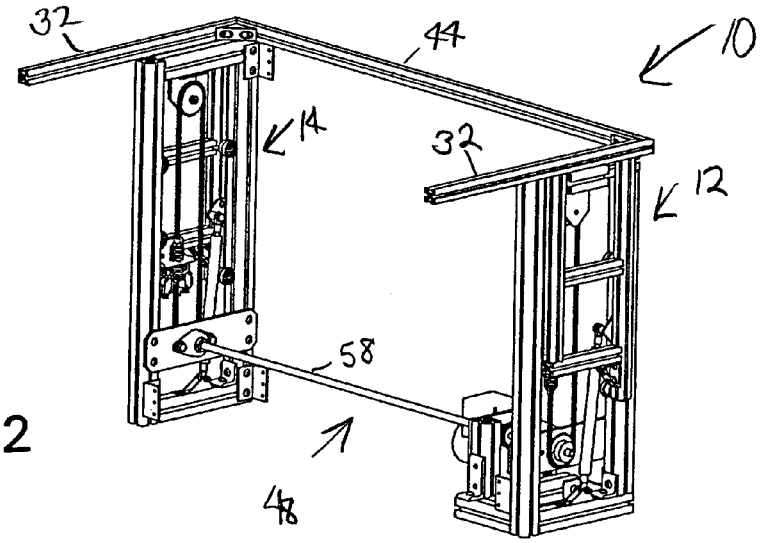
FIG. 2 is a perspective view of the elevator assembly shown in down position.
Figure 3:
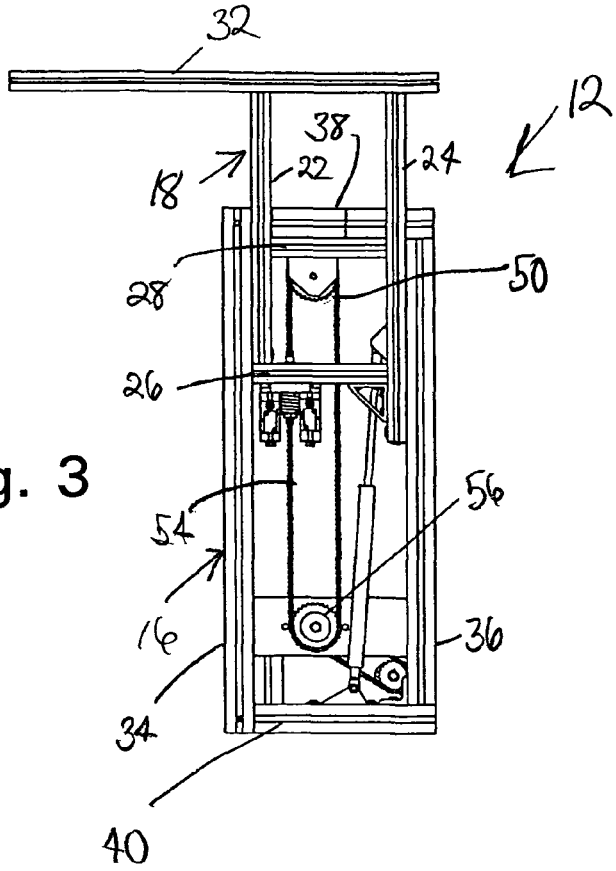
FIG. 3 is a side elevational view of a right elevator assembly.
Figure 5:
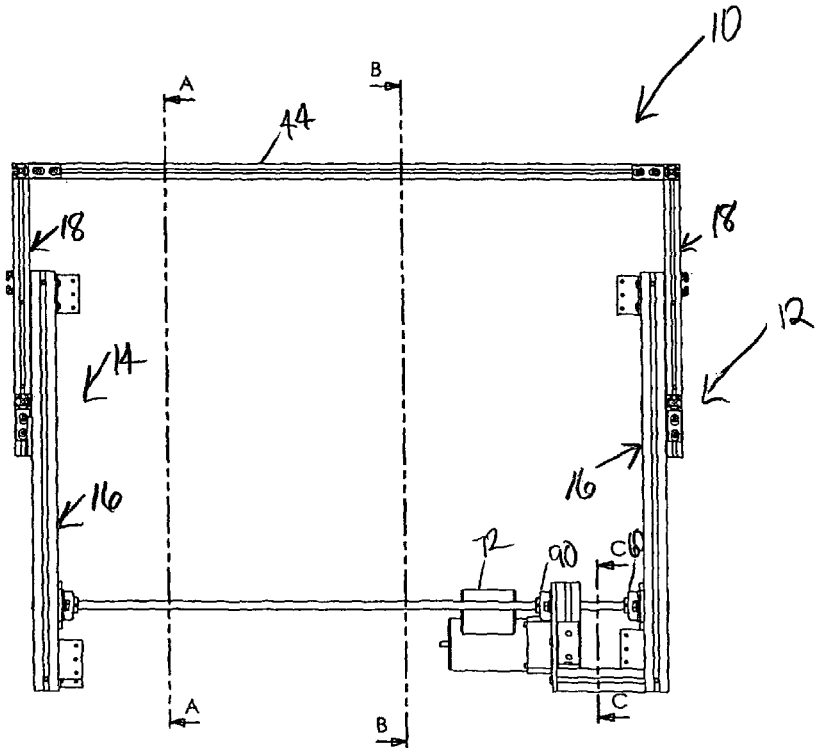
FIG. 5 is a front elevational view of the elevator unit.
Figure 5C:
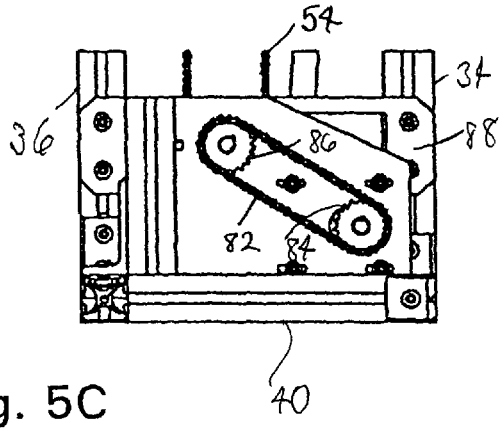
FIG. 5C is a cross section taken along line C-C in FIG. 5.
Figure 5A:
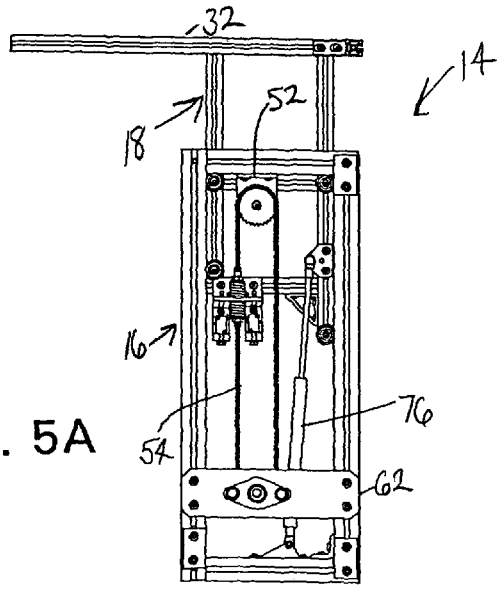
FIG. 5A is a cross section taken along line A-A in FIG. 5.
Figure 5B:
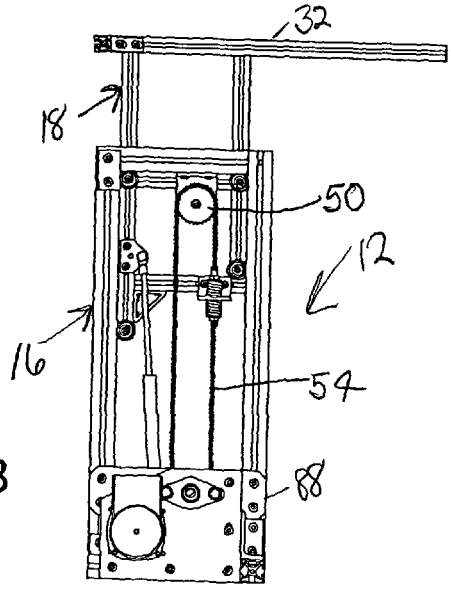
FIG. 5B is a cross section taken along line B-B in FIG. 5.
Figure 6:
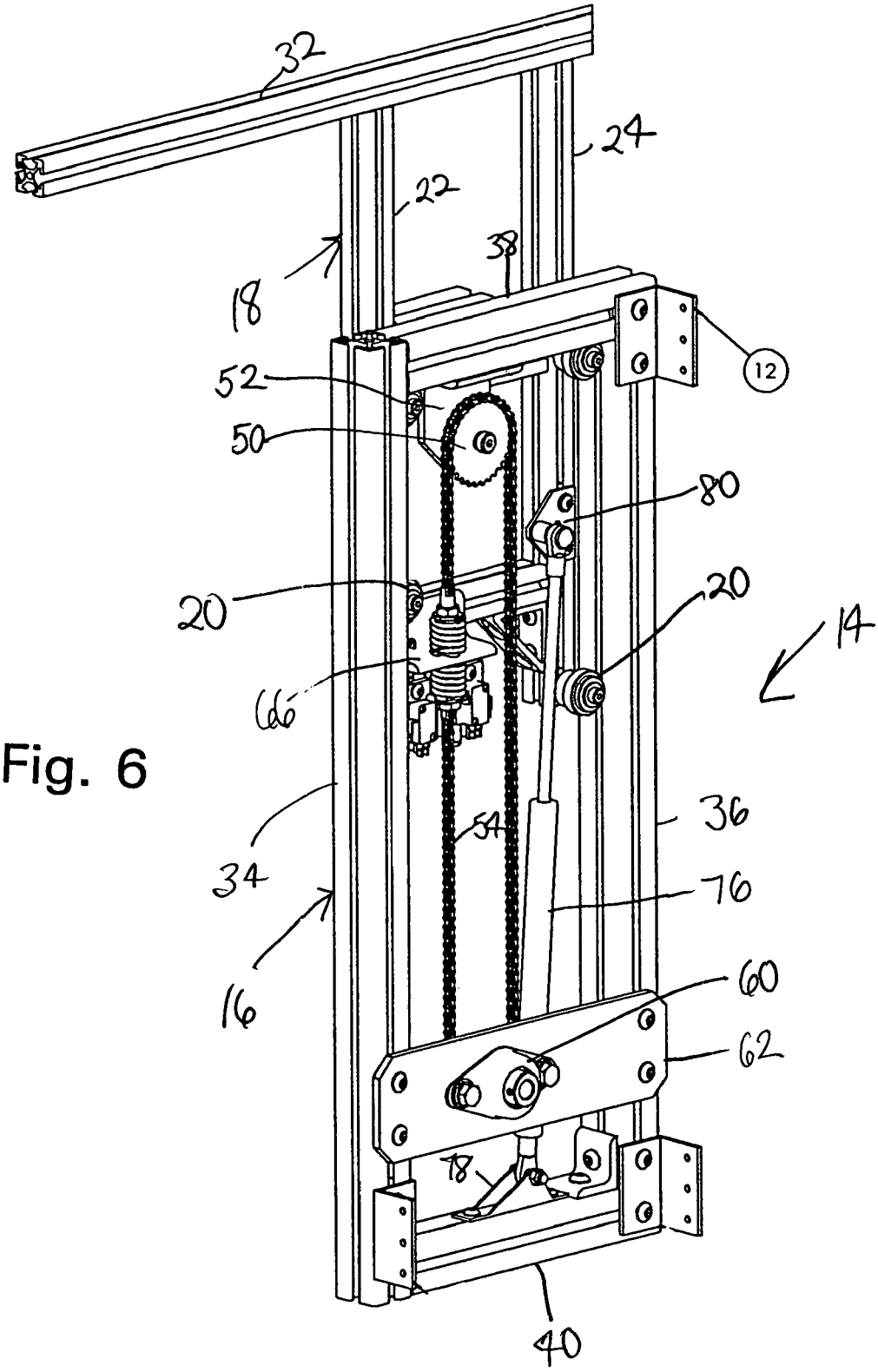
FIG. 6 is a perspective view of a left elevator assembly shown in up position.

Referring to the drawings more particularly by reference character and starting with FIG. 1, reference character 10 refers to an elevator unit in accordance with the present invention. Elevator unit includes right and left elevator assembles 12, 14, respectively, shown in sections FIGS. 5A and 5B.

Figures 7, 7G, 7H:
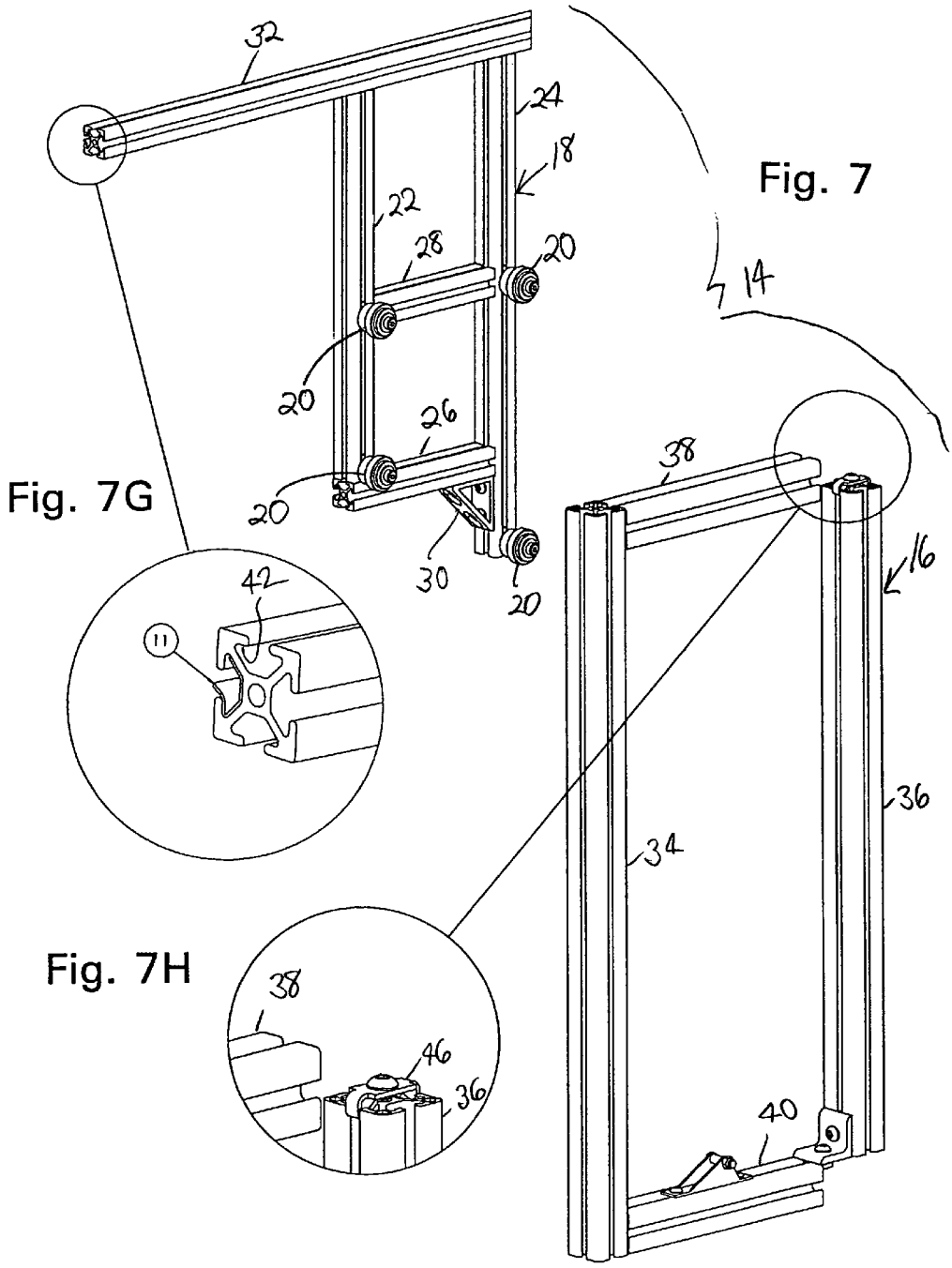
FIG. 7 is a perspective view a movable top frame with guide rollers attached to allow for interface with a stationary bottom frame.
FIG. 7G is a detail from FIG. 7 showing T-slotted framing material from which the top and bottom frames are constructed.
FIG. 7H is a detail from FIG. 7 showing attachment hardware for the T-slotted framing material.
Figure 9:
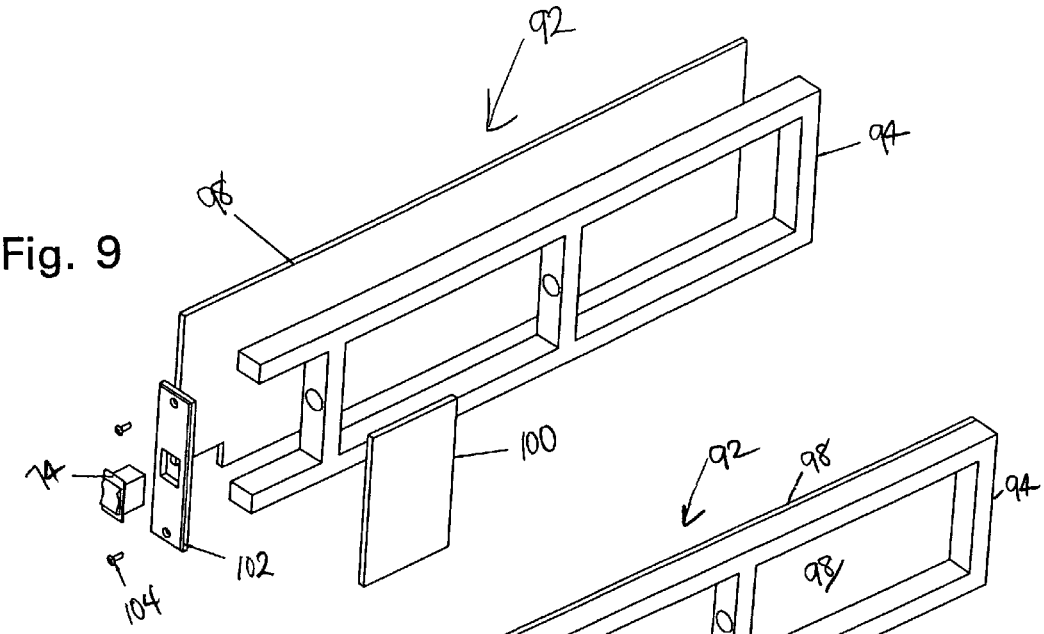
FIG. 9 is an exploded perspective view of a righthand interface frame.
Figure 10:
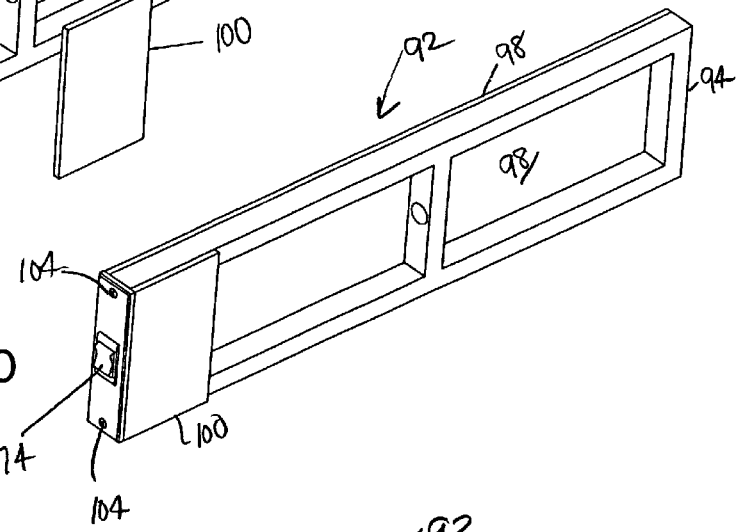
FIG. 10 is an assembled view of the righthand interface frame.
Figures 11, 12:
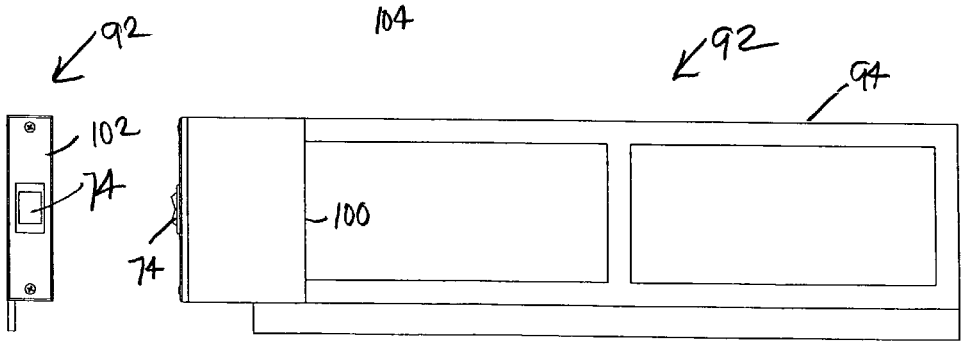
FIG. 11 is a side elevational view of the righthand interface frame.
FIG. 12 is a front elevational view of the righthand interface frame.
Figure 13:
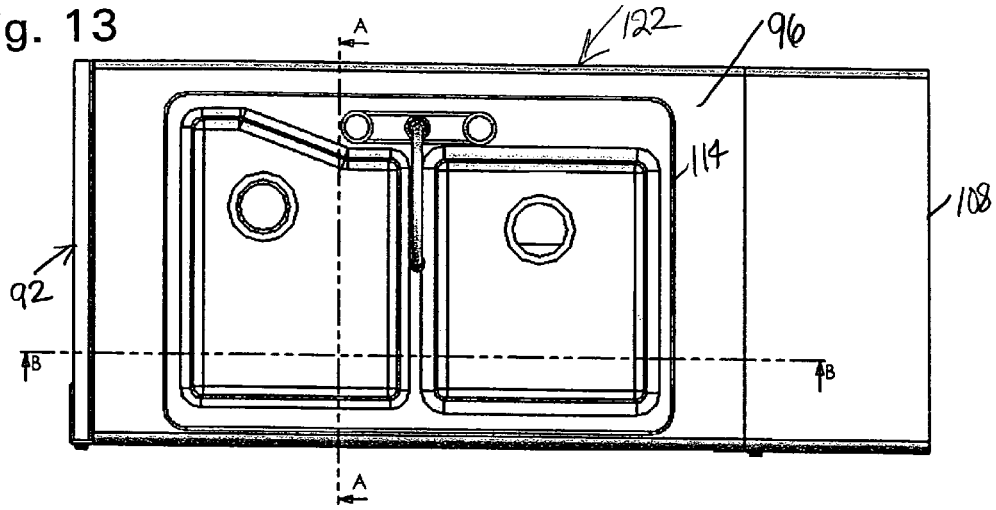
FIG. 13 is a top plan view of a sink mounted in a base cabinet with the work surface mounted on the elevator unit.
Figure 13A:
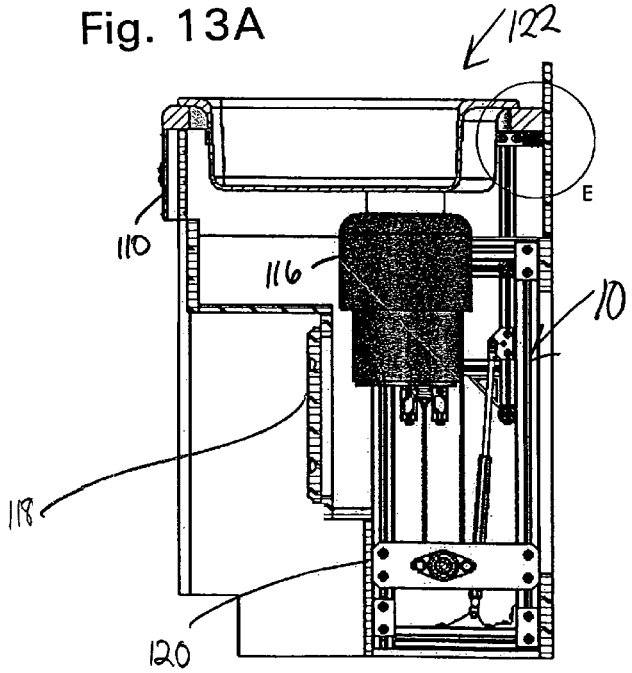
FIG. 13A is a cross section taken along line A-A in FIG. 13 showing a valance board mounted to the front bottom of the counter top.
Figure 13E:
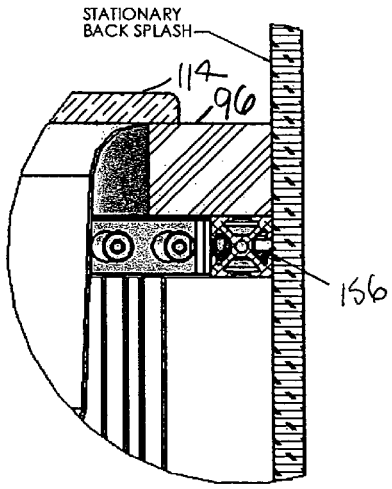
FIG. 13E is a detail taken in FIG. 13A showing a seal between a back frame of the elevator unit and a stationary back splash.
Figure 13B:
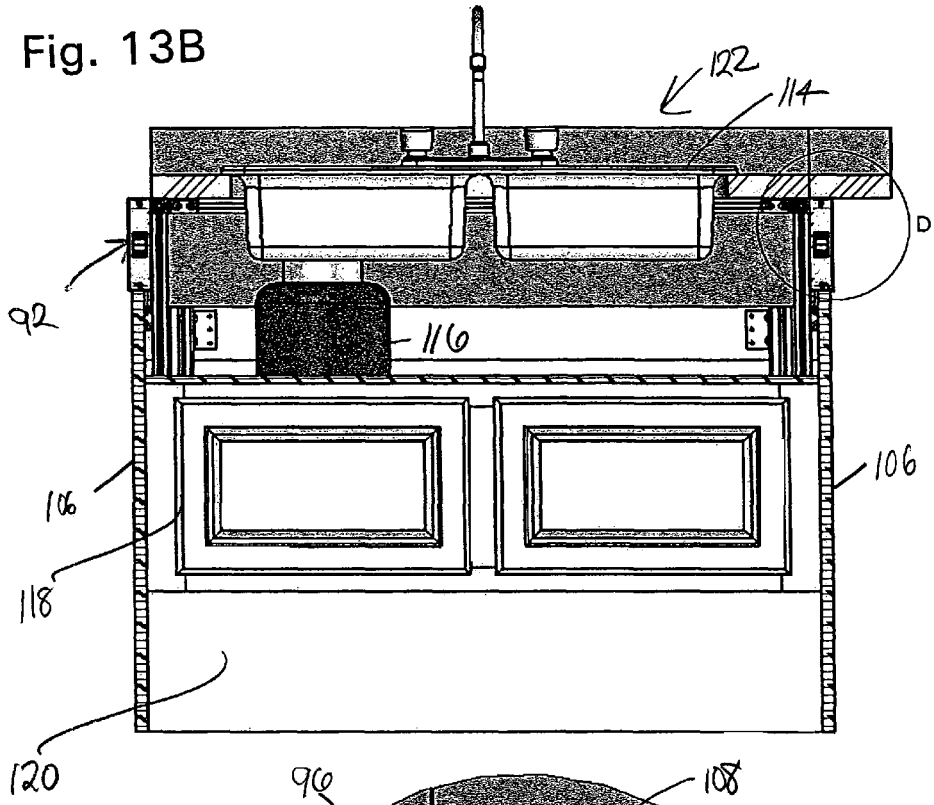
FIG. 13B is a cross section taken along line B-B in FIG. 13.
Figure 13D:
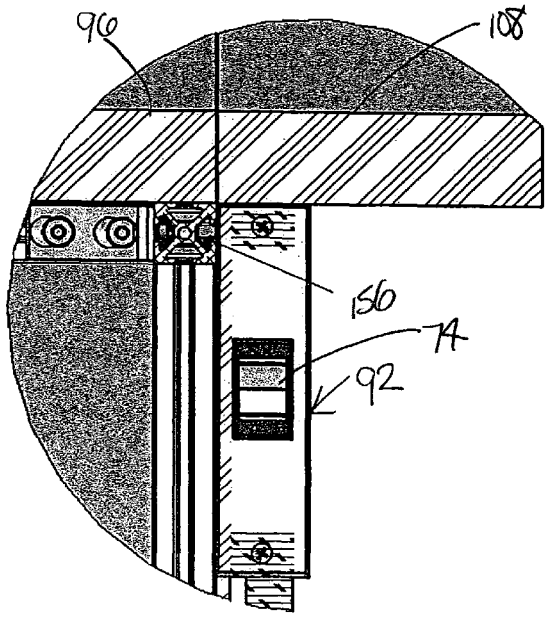
FIG. 13D is a detail taken in FIG. 13B showing the seal between the elevator unit and the righthand interface frame.
Figure 14:
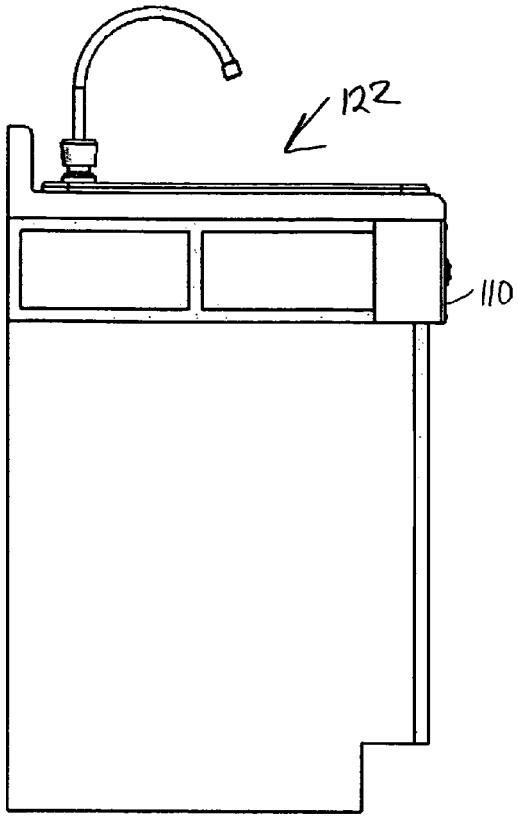
FIG. 14 is a left side view of a cabinet with the elevator unit installed in up position.

Each of elevator assemblies 12, 14 has a bottom frame sub-assembly 16 and a movable top frame sub-assembly 18 with guide rollers 20 attached to one of said frames, illustrated as top frame 18. Rollers 20 allow for interface of top frame 18 with bottom frame 16 and provide for movement of elevator assemblies 12, 14. As shown in FIGS. 1-8, top frame 18 has a pair of spaced apart vertical rails 22, 24, the latter of which is longer, which are joined with a lower horizontal rail 26 and an intermediate rail 28. A reinforcing gusset 30 braces vertical rail 24 to lower rail 26. In the for illustrated, four rollers 20 are provided but more or less rollers may be used. As shown in FIG. 7, two of rollers 20 are mounted on the face of vertical rails 22, 24 at intermediate rail 28 and the other two are mounted on the face of vertical rails 22, 24 near their respective lower ends. A work counter mounting rail 32 is mounted on the upper ends of vertical rails 22, 24 and completes top frame 18. With continuing reference to FIG. 7, bottom frame 16 includes a pair of spaced apart vertical rails 34, 36 which are joined top and bottom with horizontal rails 38, 40, respectively. The spacing between rollers 20 on top frame 18 and the inside of vertical rails 34, 36 of bottom frame 16 is such that rollers 20 are received in a T-slot 42 provided in opposing sides of rails 34, 36. Right and left elevator assemblies 12, 14 are joined by rear counter top brace 44.

As shown in FIG. 7G, vertical rails 22, 24 of top frame 18 and vertical rails 34, 36 of bottom frame 16 are preferably formed of T-slotted framing. The framing is available as standard extruded profile aluminum which permits the use of standard attachment hardware 46, an example of which is shown in FIG. 7H. Use of T-slotted framing provides substantial structural integrity as well as flexible mounting of components, such as rollers 20, to top and bottom frames 18, 16 and is preferably used for horizontal members 26, 28, 32, 38, 40 and 44 also.

Up and down movement of elevator assemblies 12, 14 is accomplished by way of a drive assembly 48, illustrated but not limited to a roller chain drive arrangement. A driven pulley 50, illustrated as an idler sprocket and shown in section in FIG. 8E, is comprised of a standard sprocket with a bronze bushing pressed in the bore and a steel shoulder screw is utilized for the axle that is attached to an angle bracket 52 on top rail 38 of bottom frame 16. As shown in the drawings other than for FIGS. 31-32, driven pulley 50 is mounted to top rail 38 of bottom frame 16 to provide for upper support of a synchronous drive belt 54 illustrated as a roller chain which passes around a drive pulley 56 mounted to bottom rail 40 of bottom frame 16. Drive pulley 56 is illustrated as a sprocket wheel for use with roller chain 54, the particular synchronous drive belt shown in the drawings. A common drive shaft 58 interconnects drive pulleys 56 of right and left elevator assembles 12, 14 and completes the main elements of drive assembly 48. Drive shaft 58 is guided and supported in each elevator assembly 12, 14 by a bearing unit 60, affixed to a suitable mount plate 62.

As shown in detail in FIG. 8F, one end of roller chain 54 is connected to a connecting link 64 which passes through an angle bracket 66 attached lower rail 26 of top frame 18, while the other end of the chain is similarly attached to the bottom of connecting link 64. Compression springs 68, 70 are located above and below angle bracket 66 to allow for float or misalignments between left and right elevator assemblies 14, 12. When the system reaches either up or down hard stop travel limiters, springs 68, 70 compress respectively to allow for the float and relived strain on the drive components.

With continuing reference to FIG. 8F, a pair of limit switches, LS1 and LS2, are provided and which, when the elevator travel is stopped by the limiters and springs 68, 70 are compressed, are tripped to disconnect electrical power to a system drive motor 72. One switch, LS1, controls the upward movement and the other switch, LS2, controls downward movement. This attachment assembly may be placed on either right or left elevator assembly 12, 14, which placement is primarily dictated by desired placement a primary control switch 74, left or right, and associated wiring.

A primary safety feature of limit switches, LS1 and LS2, is that if an obstruction is encountered while elevator assemblies 12, 14 are moving, either up or down, the appropriate limit switch will trip and disconnect electrical power to drive motor 72 and stop movement in that direction. Movement in the opposite direction is available through primary control switch 74 such that travel can be reversed and the obstruction removed. Drive assembly 48 on opposite elevator assembly 14 is similar but need not have limit switches, LS1 and LS2.

Each elevator assembly 12, 14 includes a counter balance 76 illustrated as a standard compression gas spring. Gas spring 76 is attached with suitable mounting brackets 78, 80 to bottom frame 16 and to top frame 18 for offsetting load on the system. The load capacity of counter balance 76 may be sized in accordance with the type of counter top and attachment thereto, with respect to the amount of weight that must be supported or counterbalanced. Other means for effecting a counter balance including other suitable springs or dead weight attachments may be used.

Figure 4:
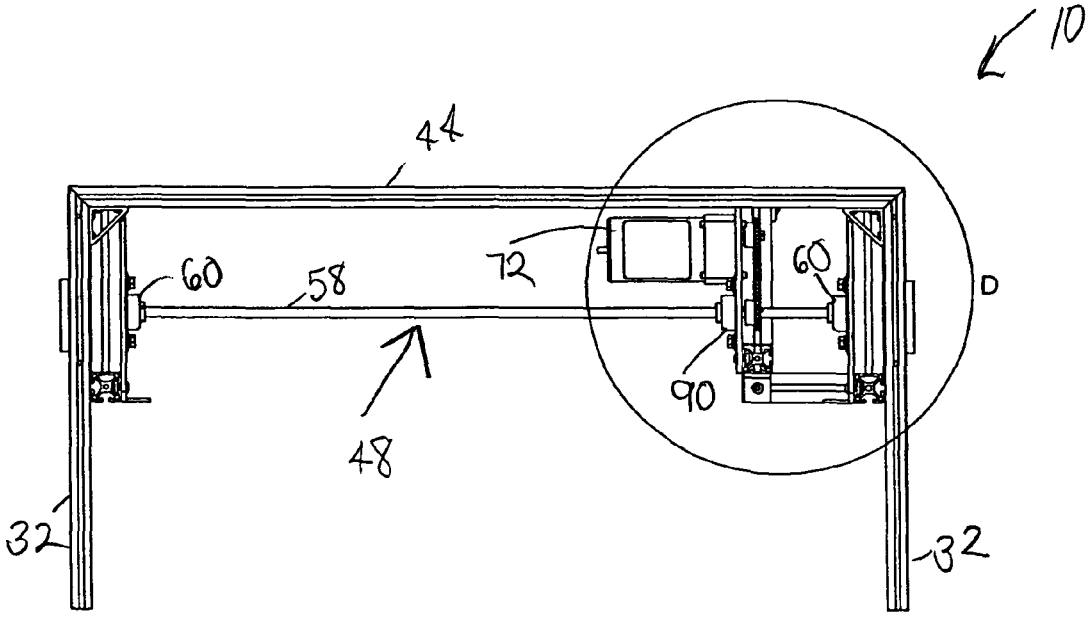
FIG. 4 is a top plan view of the elevator unit.
Figure 4D:
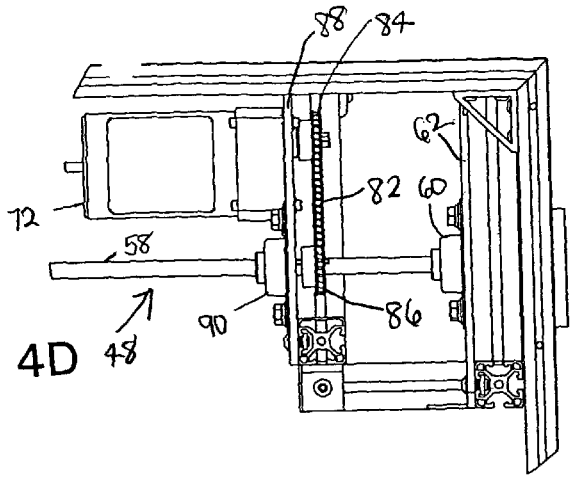
FIG. 4D is a detail showing the drive assembly of the elevator unit.

Drive assembly 48, as shown in detail in FIG. 4D, may further includes a drive belt 82, such as a roller chain, attached to a sprocket 84 on the drive shaft of motor 72 and another sprocket 86 on common drive shaft 58. Sprockets 84, 86 are coupled together with drive belt 82 to provide rotary power to each elevator assembly 12, 14. A mounting framework 88 provides support of motor 72 as well as a support-bearing unit 90. Motor 72 may be a reversible AC electric motor with a power brake attached thereto. Alternatively, a DC electric motor could be used instead, or a transmission.

Referring now to FIGS. 9-12, primary control switch 74 is illustrated housed in a right hand interface frame 92. A core 94 of interface frame 92 may be formed from wood components to allow space to run control wiring. On the inside of the assembly, adjacent a movable counter top 96, a laminate-faced component 98 may be attached, consistent with decorative requirements. The outside of interface frame 92 may include a plywood component 100, consistent with wood finishing requirements. A switch mounting plate 102 is attached to the front of interface frame 92 with screws 104. Control switch 74, illustrated as a spring centered three-position rocket switch, is pressed into switch mounting plate 102.

Turning to FIGS. 13-17, when interface frame 92 is mounted to the top of a cabinet side 106, interface frame 92 provides accommodation for attachment or interface of adjacent stationary counter tops 108. Also, the design eliminates pinch points between the stationary and movable counter top front and side edges.

Figure 15:
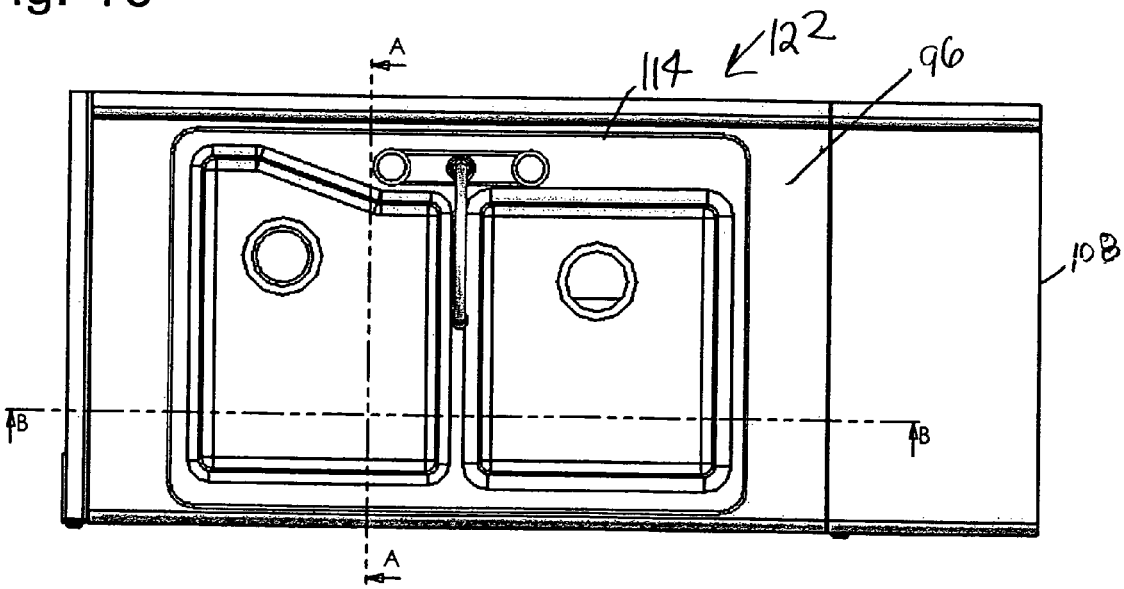
FIG. 15 is a top view of the cabinet and adjacent stationary counter top.
Figure 15A:
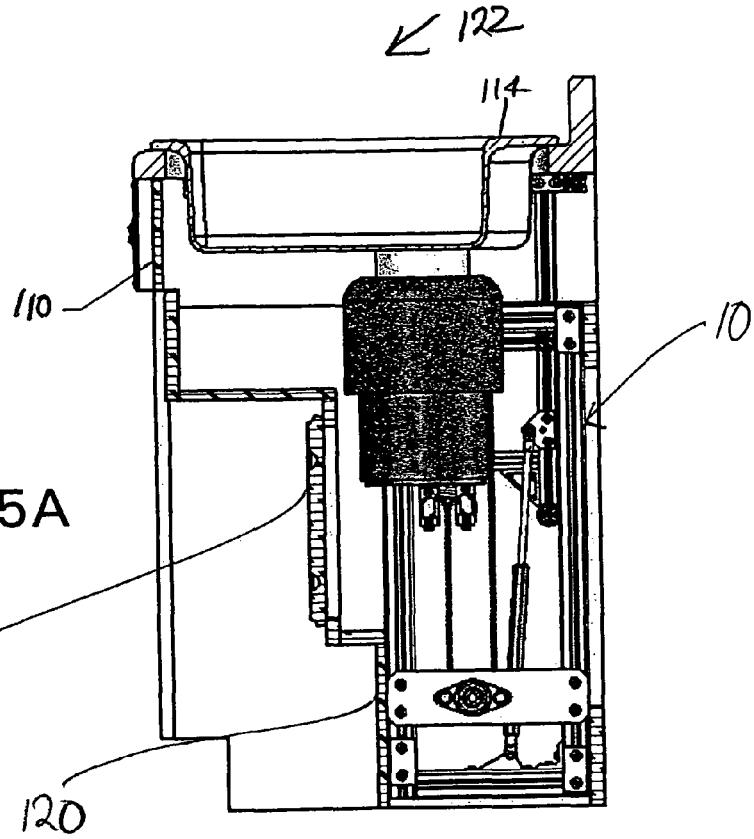
FIG. 15A is a section taken along line A-A in FIG. 15.
Figure 15D:
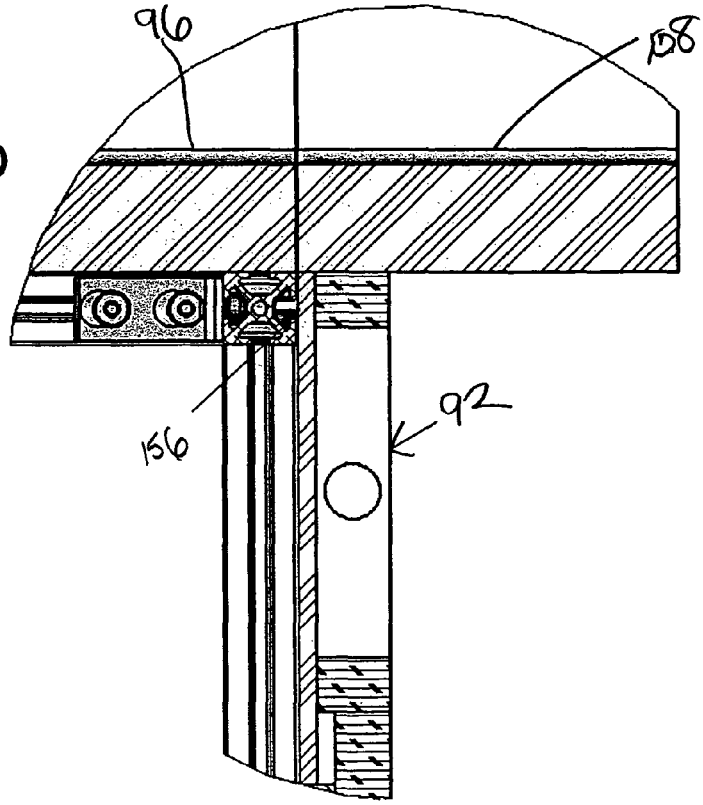
FIG. 15D is a detail from FIG. 15B showing the interface with the adjacent stationary counter top.
Figure 15B:
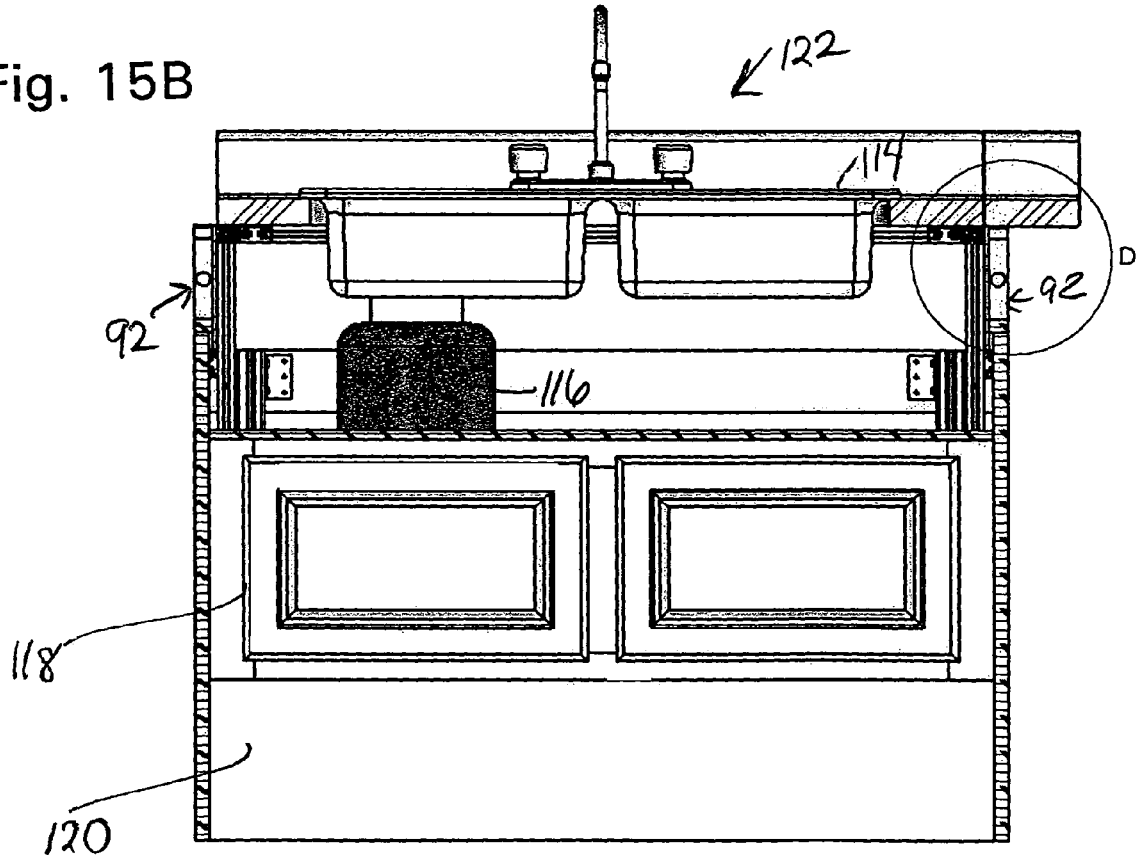
FIG. 15B is a cross section taken along line B-B in FIG. 15.
Figure 16:
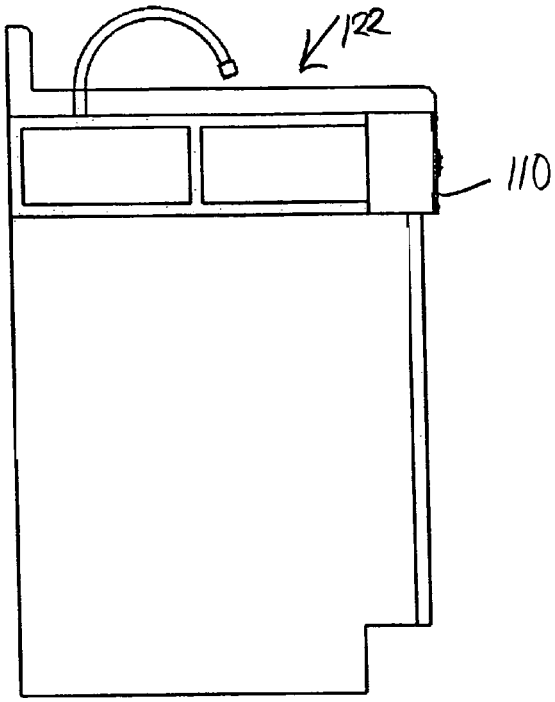
FIG. 16 is a left side view of the cabinet with the elevator unit installed in down position.
Figure 17:
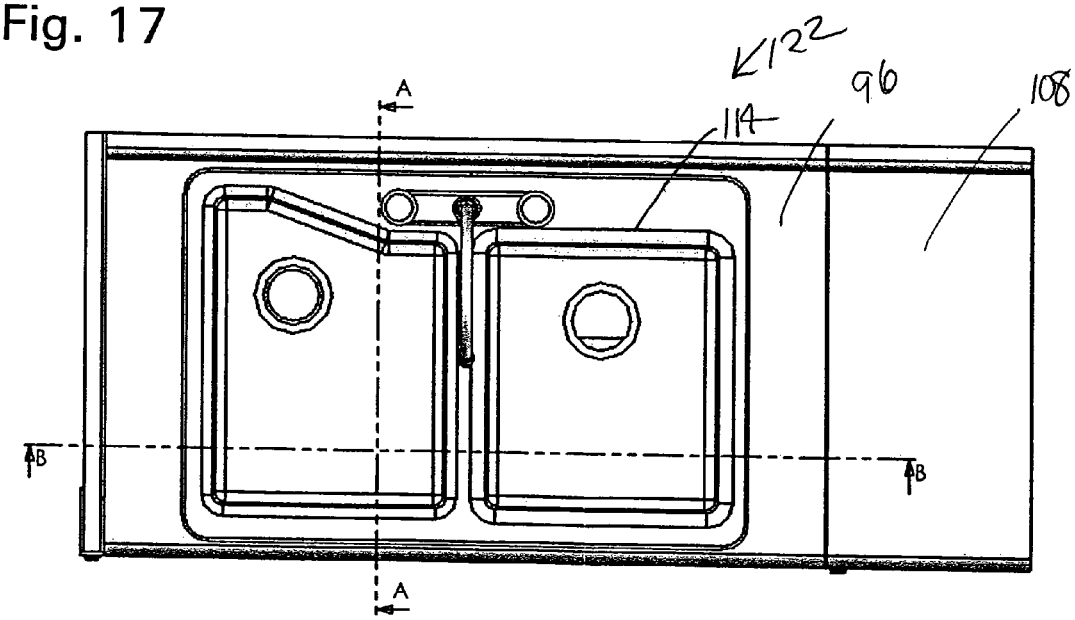
FIG. 17 is a top view of the cabinet and the adjacent counter top.
Figure 17A:
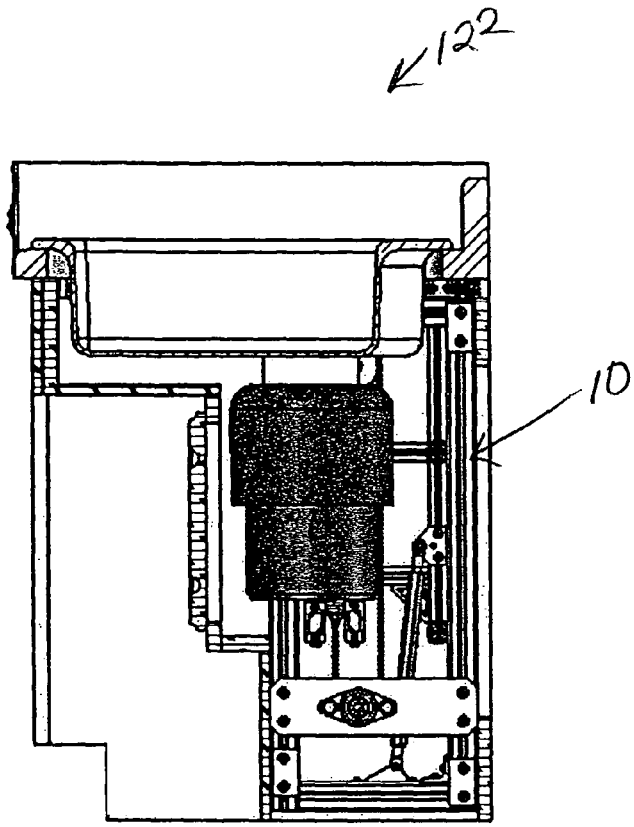
FIG. 17A is a cross section taken along line A-A in FIG. 17.
Figure 17D:
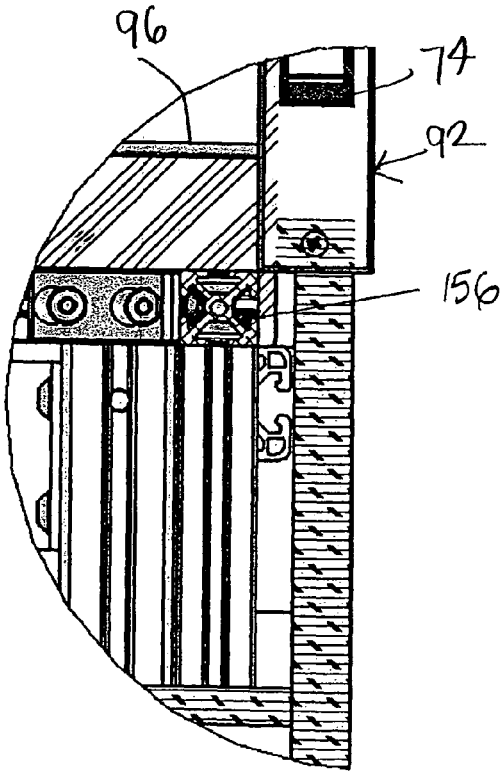
FIG. 17D is a detail from FIG. 17B showing the interface with the adjacent stationary counter top.
Figure 17B:
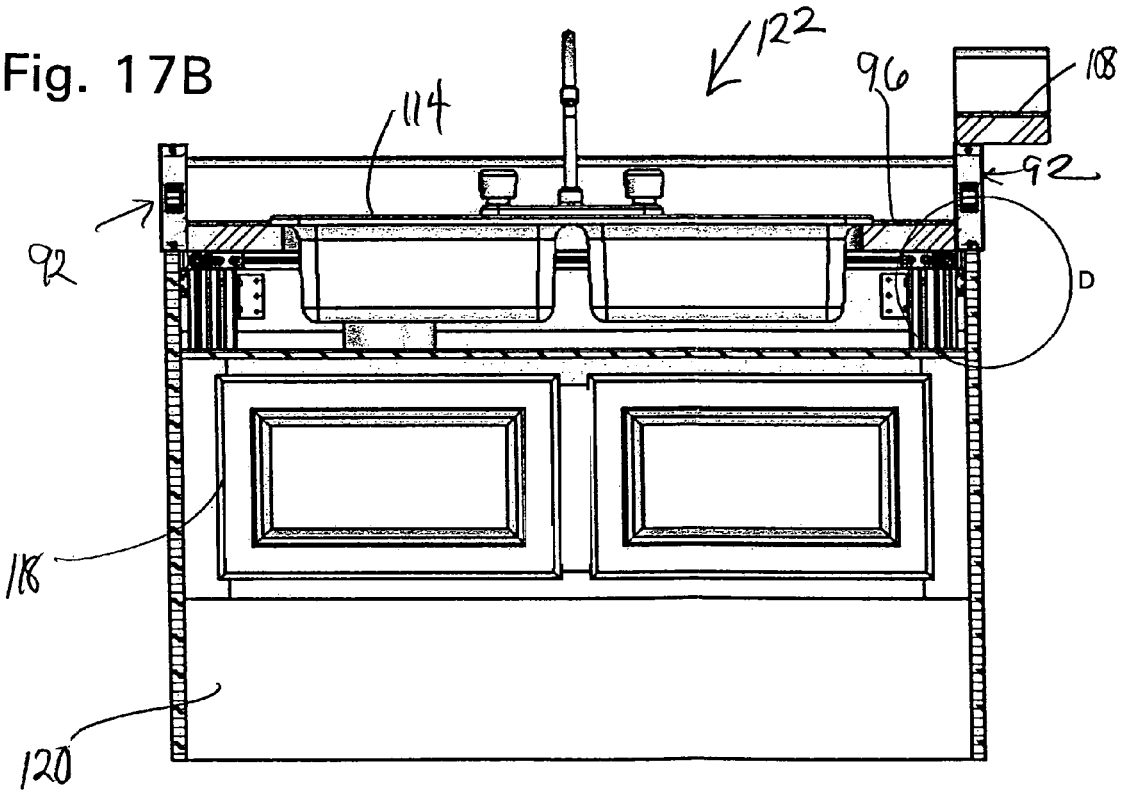
FIG. 17B is a cross section taken along line B-B in FIG. 17.
Figure 18:
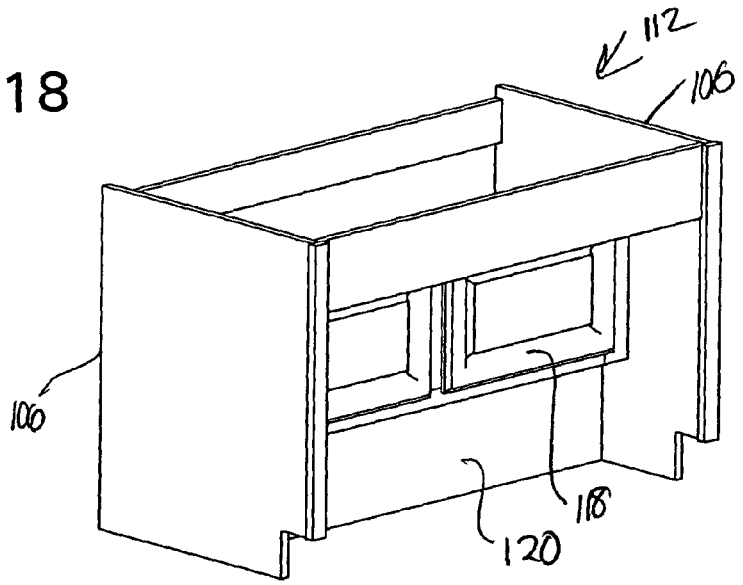
FIG. 18 is a perspective view of the base cabinet shown in FIGS. 16 and 17 before the elevator unit is installed.
Figure 19:
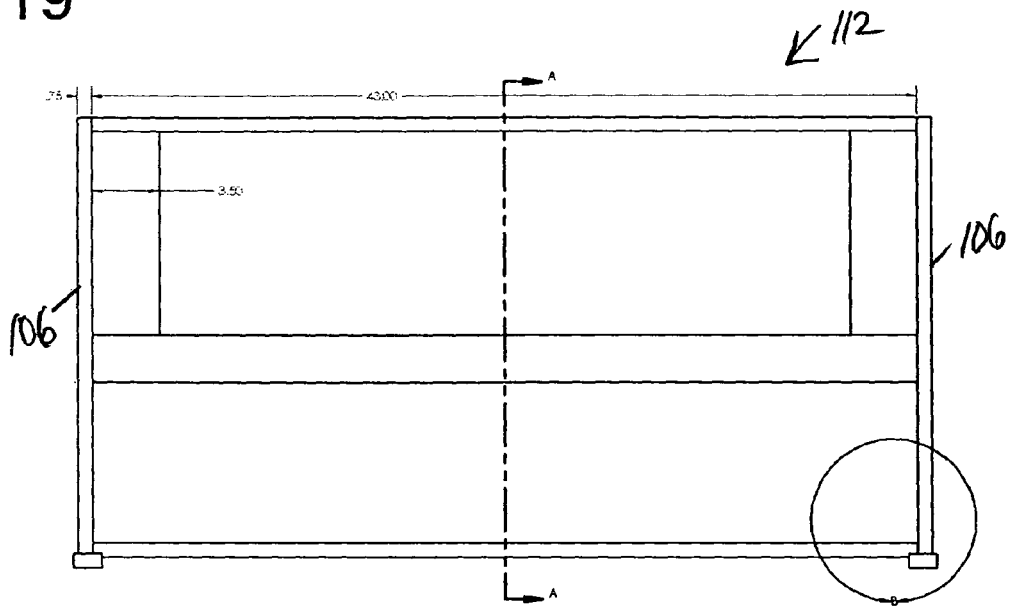
FIG. 19 is a top plan view of the base cabinet.
Figure 19A:
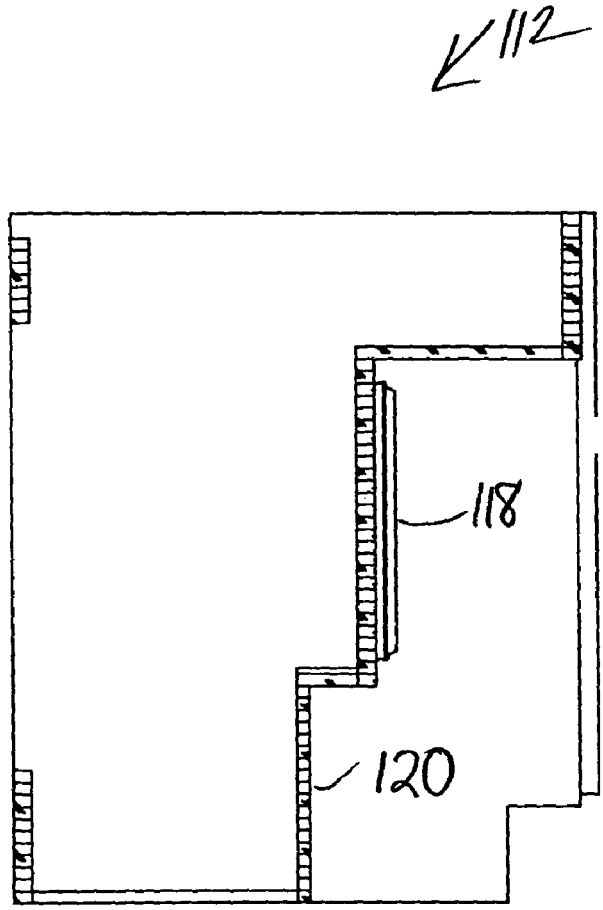
FIG. 19A is a cross section taken along line A-A in FIG. 19 showing clearance for a garbage disposal and with a recessed door frame to provide clearance for a regular chair or a wheelchair and with an enlarged toe kick of adequate height to clear wheelchair foot supports.
Figure 19B:
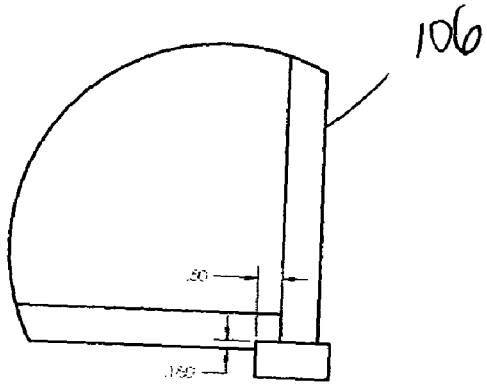
FIG. 19B is a construction detail from FIG. 19.

If desired, primary control switches 74 could be mounted in both sides 106. Or, one side could be used to install and on/off two-position rocker switch (not shown) for control of a garbage disposal. Or, if a rocker switch is not required on one of interface frames 92, then a blank switch plate may be mounted instead. As shown in FIG. 15A, a valance board 110 is mounted to the front bottom of movable counter top 96. This valance board 110 completes the enclosure of cabinet 112 with elevator unit 10 installed.

FIGS. 18-22 show cabinet 112 constructed by methods, materials and procedures common in the cabinet building industry. Primary features of cabinet 112 include internal clearance for a sink 114 with a garbage disposal 116 shown in previously described drawings. Also, a cabinet doorframe 118 is recessed to provide under cabinet clearance for utilization of a regular chair or clearance for a wheelchair. A toe kick area 120 in the bottom front of cabinet 112 has adequate height to clear foot supports on most wheelchairs.

Figure 23:
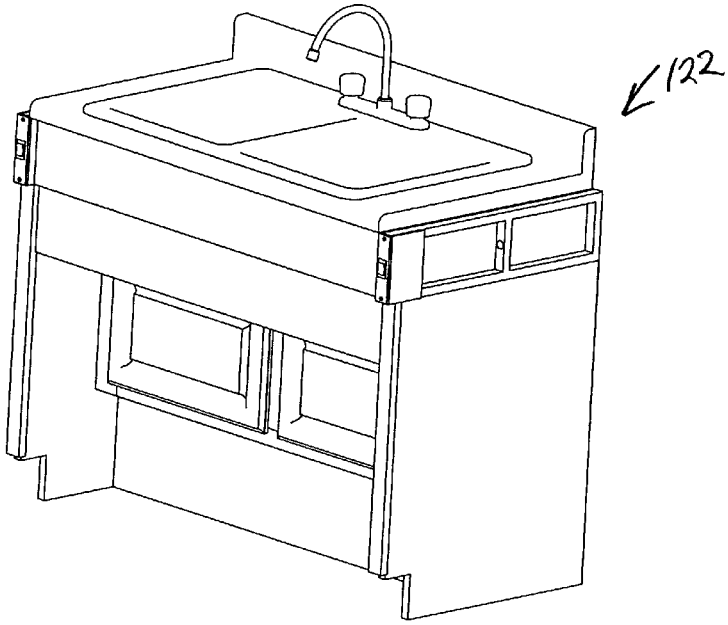
FIG. 23 is front perspective view of the base cabinet with the elevator unit installed shown in up position.
Figure 24:
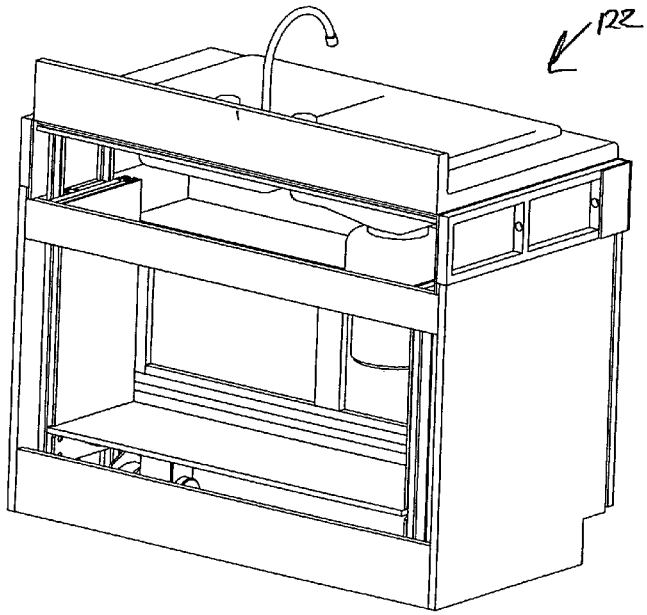
FIG. 24 is rear perspective view of the base cabinet with the elevator unit installed shown in up position.
Figure 25:
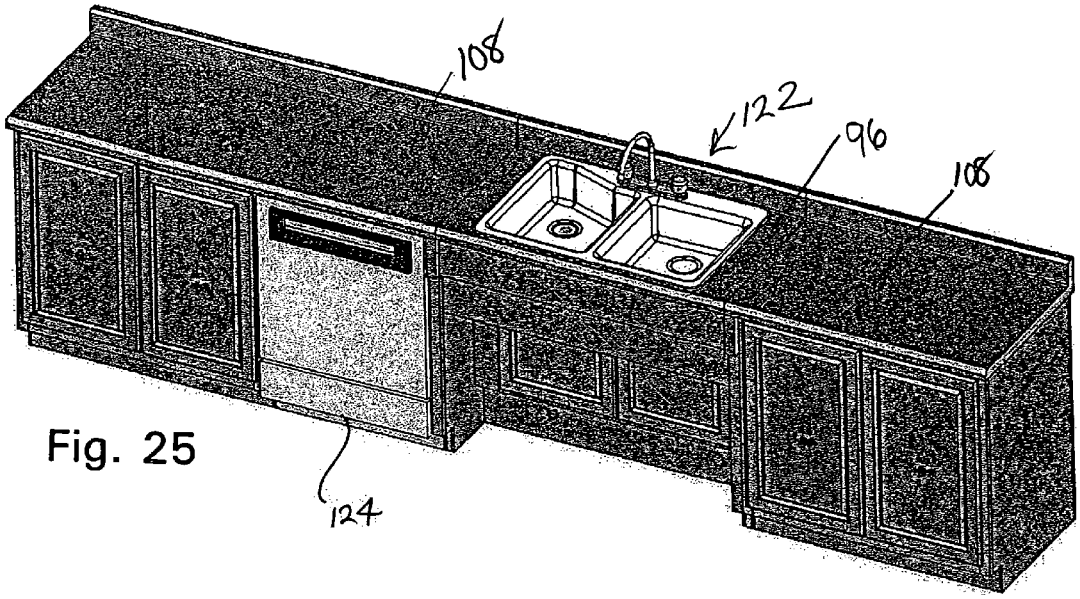
FIG. 25 is front perspective view of a typical installation showing the sink unit illustrated in FIGS. 23-24 with standard cabinets, with the adjustable top in the up position.
Figure 26:
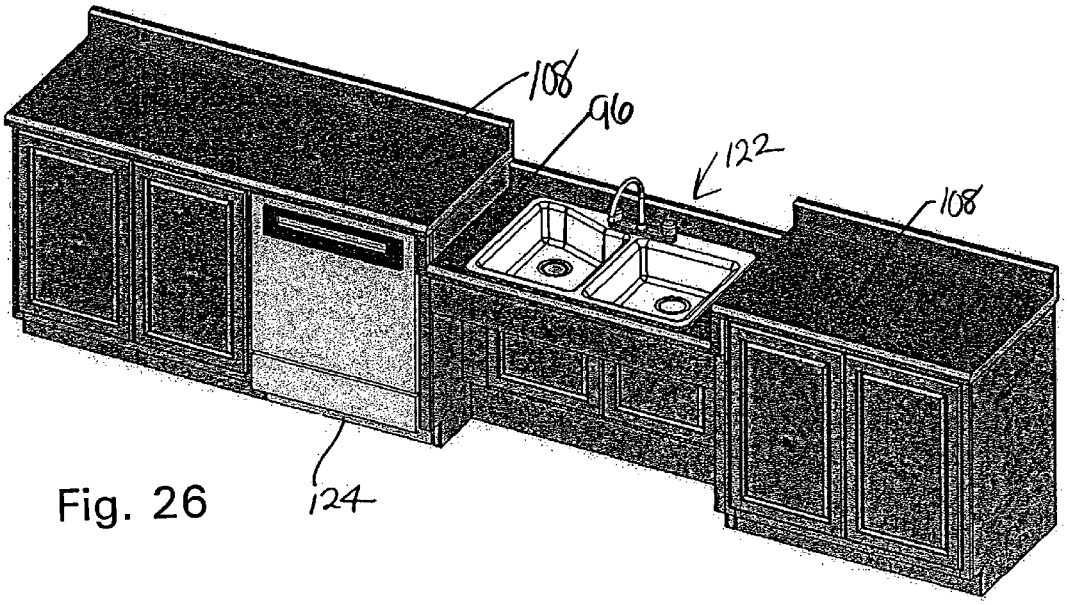
FIG. 26 is a front perspective view of the typical installation in FIG. 25 with the adjustable top in the down position.
Figure 27:
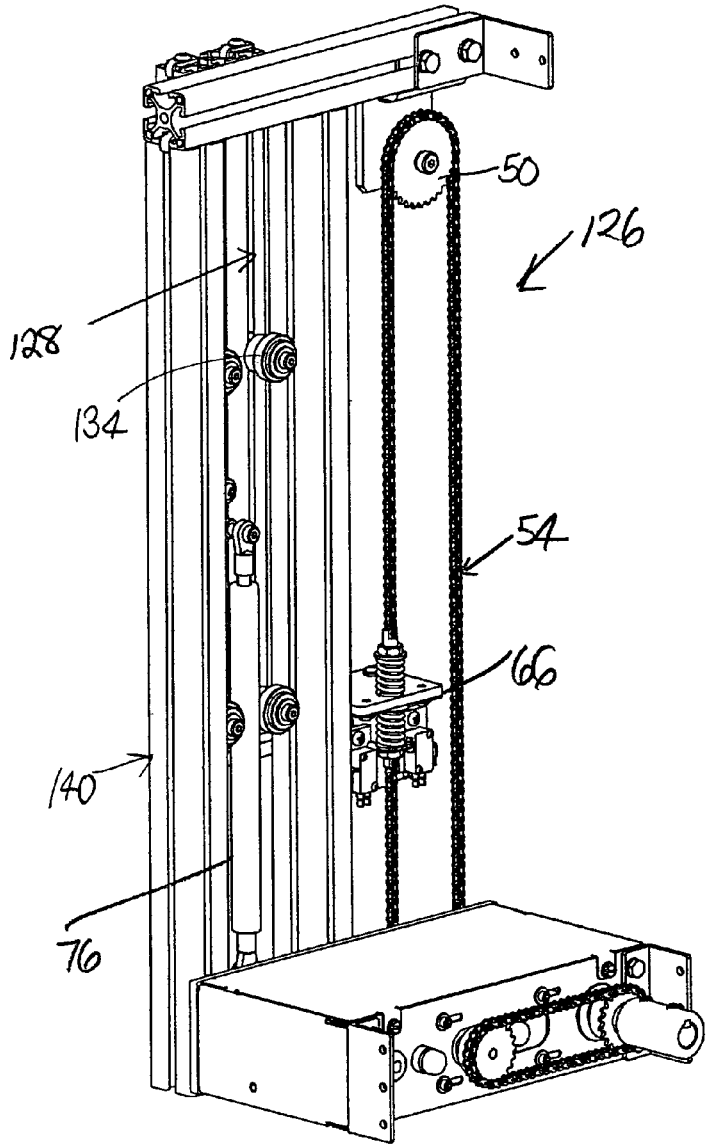
FIG. 27 is a perspective view showing a second embodiment of the elevator unit wherein the stationary bottom frame of each elevator assembly is formed as a post.
Figure 29A:
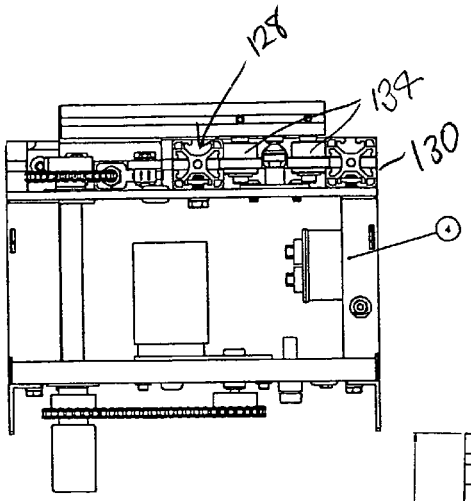
FIG. 29A is a detail from FIG. 29 showing the drive assembly of the elevator unit.
Figure 30:
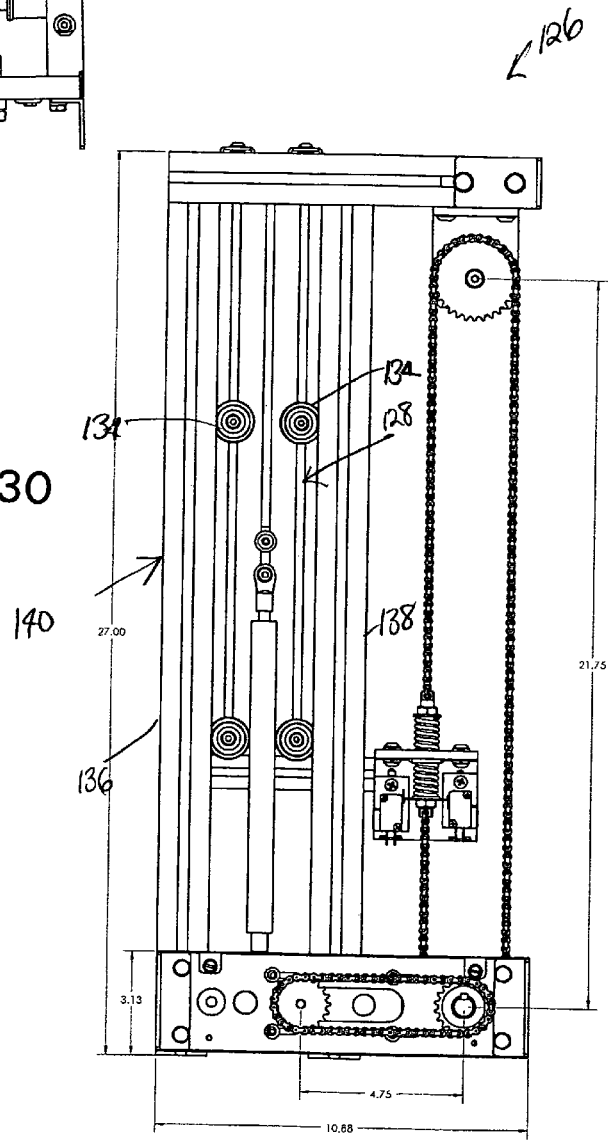
FIG. 30 is a side elevational view of the left elevator assembly viewed from the inside.

When elevator unit 10, base cabinet 112, interface frames 92 and movable counter top 96 are combined, a complete base cabinet unit assembly 122 is obtained as illustrated in FIGS. 23-24. As illustrated in FIGS. 25-26, base cabinet unit assembly 122 may be used in a typical kitchen layout along with adjacent cabinets with fixed position counter tops as well as a typical dishwasher 124. FIG. 23 illustrated sink base cabinet unit assembly 122 in up position; FIG. 24 with the top shown in the down position.

A second embodiment of elevator unit is shown in FIGS. 27-30, a left elevator assembly 126 of which is illustrated. Elevator assembly 126 is similar to elevator assemblies 12, 14 previously described except primarily the construction of a top frame 128. As shown in the drawings, vertical rails 130, 132 are side-by-side and may be molded of extruded material as a single unit. Rollers 134 on top frame 128 are received in T-slots located on outer side of vertical rails 136, 138 of bottom frame 140. This arrangement is more compact than elevator assemblies 12, 14 previously described and may be preferred for some installations.

Figure 31:
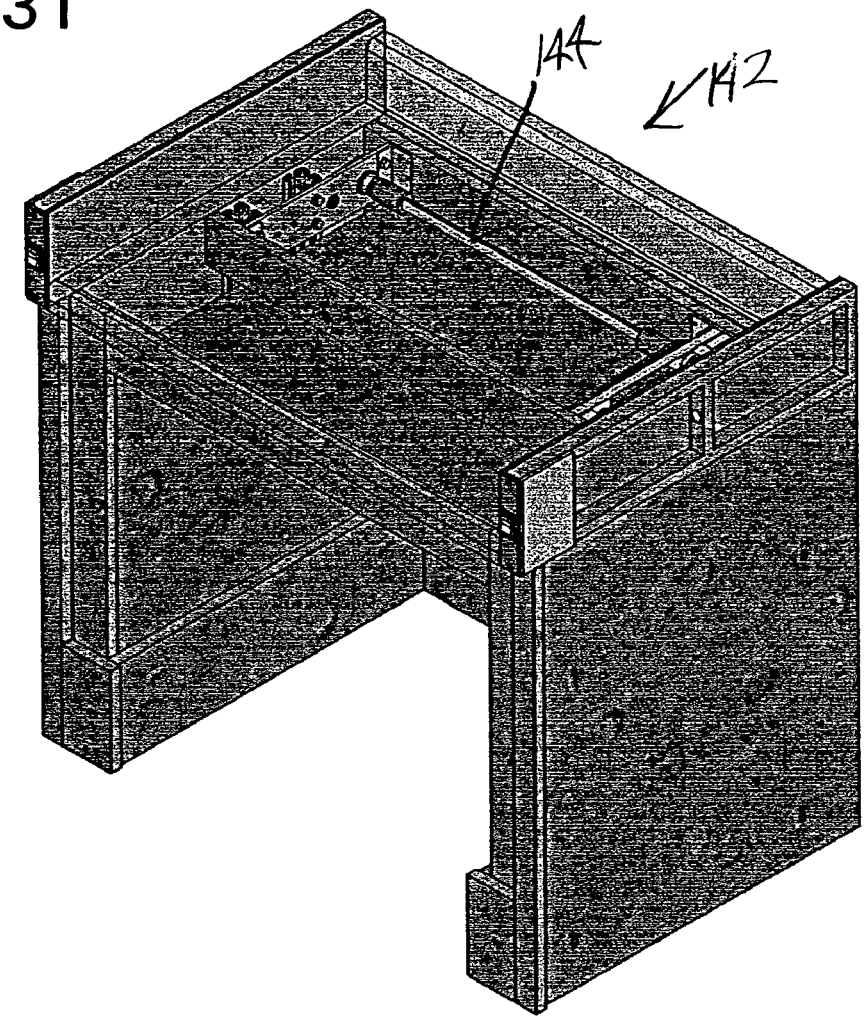
FIG. 31 is rear perspective view of desk cabinet unit showing a third embodiment of the elevator unit with an adjustable top in down position.
Figure 32:
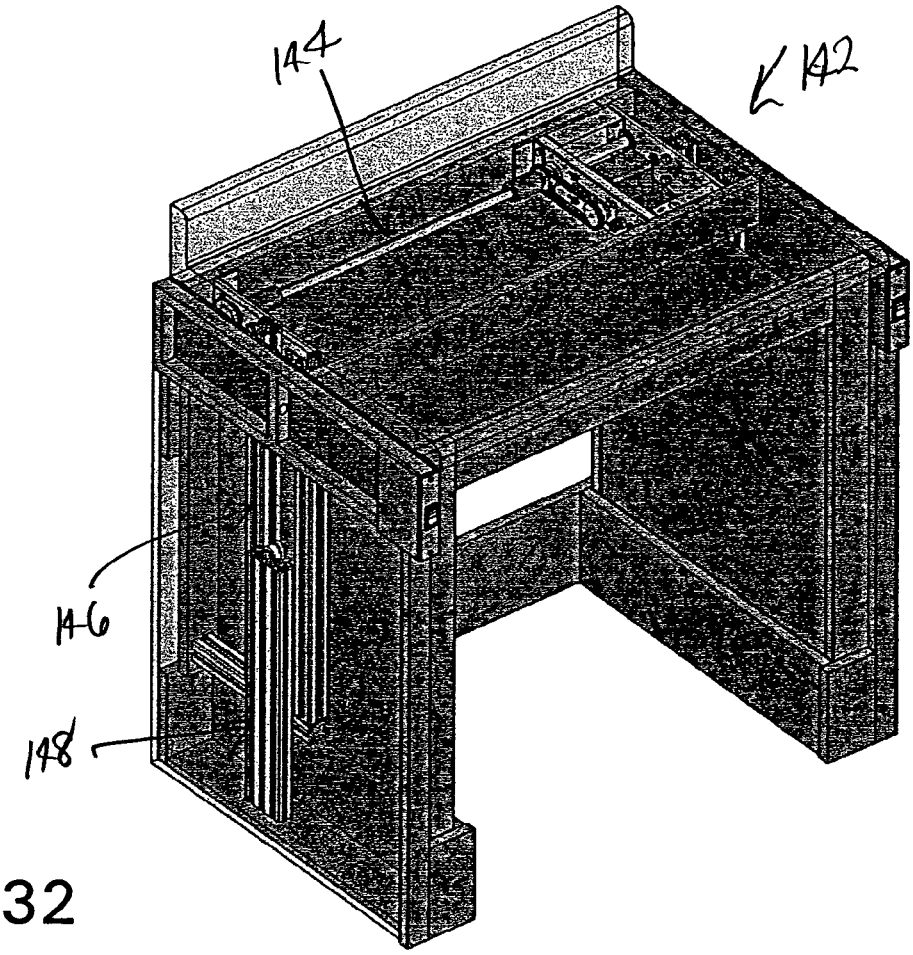
FIG. 32 is front perspective view of the desk cabinet shown in FIG. 31 with the adjustable top in up position.

A third embodiment of elevator unit 142 is shown in FIGS. 31-32. In this instance drive assembly 144 is mounted under the movable counter top with the drive and driven pulleys attached to top frame 146 and the angle bracket attached to bottom frame 148. This arrangement allows base cabinet 112 to be a desk or a work bench.

Figure 33:
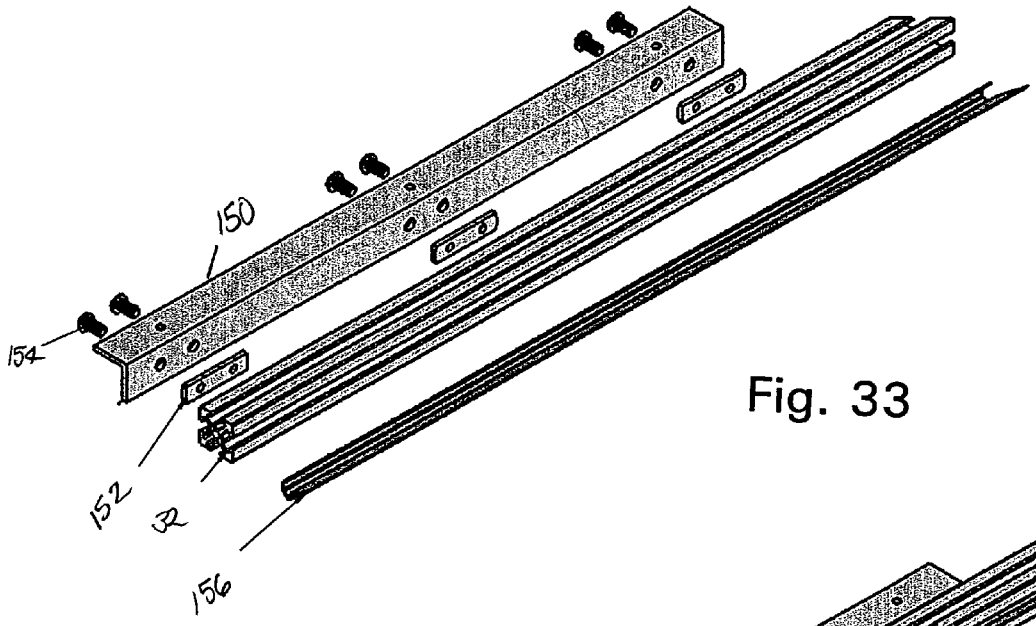
FIG. 33 is an exploded perspective view showing spill control counter top mounting details.
Figure 34:
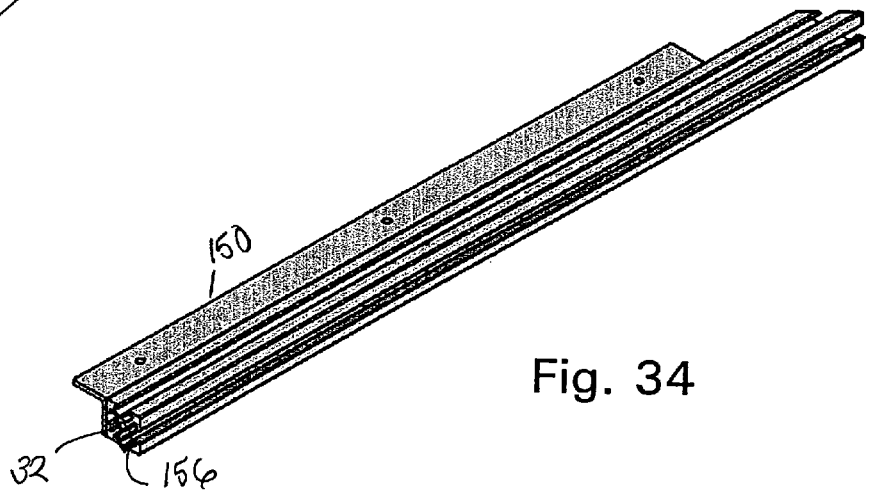
FIG. 34 is an assembled perspective view of the counter top mounting details shown in FIG. 33.

FIGS. 33-34 show details of work counter mounting rail 32 previously illustrated. Movable counter top (not shown) is attached to a mounting bracket 150 which in turn is attached with a double T-nut 152 and screws 154 into T-slot of work counter mounting rail 32. A strip 156 of flexible material is attached to T-slot on the opposite side of work counter mounting rail 32. Rear counter top brace 44 may be similarly provisioned with flexible material 156 for the purpose of preventing liquids from seeping being the movable and stationary surfaces.

Figure 35:
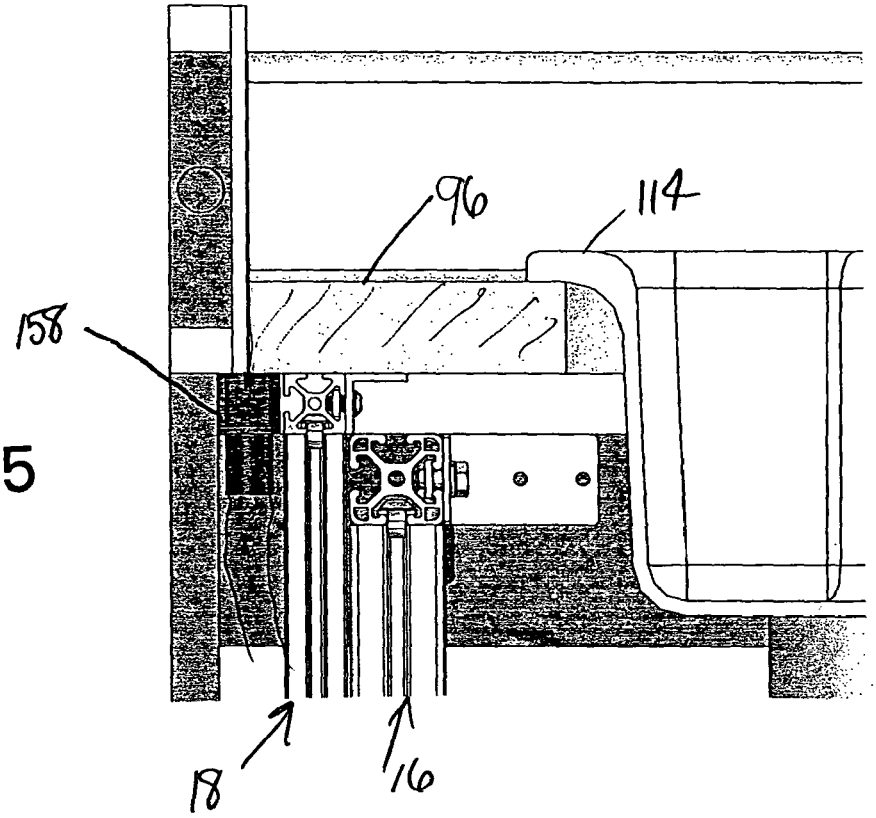
FIG. 35 is cross sectional detail of the left side of a cabinet with an elevator unit installed illustrating a spill control drainage system.
Figure 36:
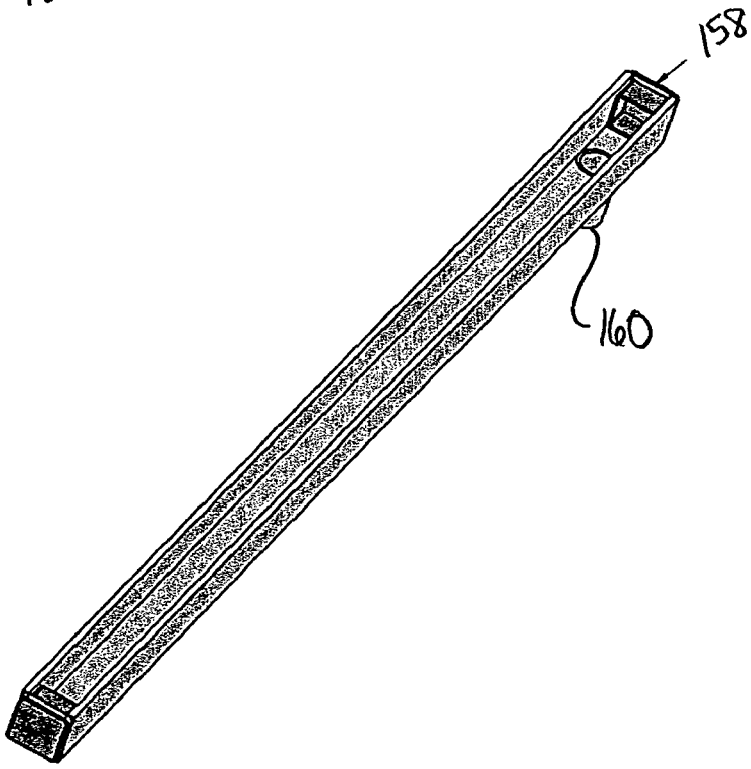
FIG. 36 is a perspective view of the spill control drainage tray.

FIGS. 35-36 illustrate another way of dealing with liquids that may seep between the movable and stationary surfaces. In this instance, a tray 158 with a drain 160 is mounted along the side edges under movable counter top 96. Drain 160 may be connected below garbage disposal 116.

Figure 37:
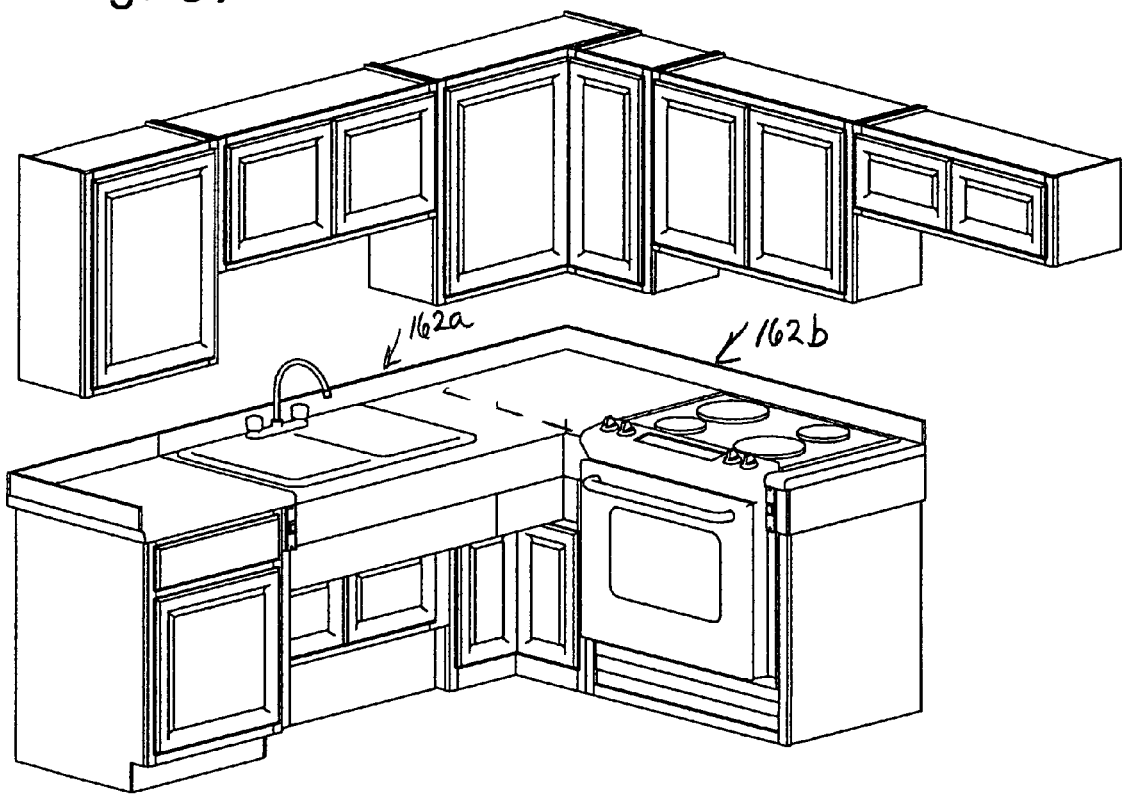
FIG. 37 is a front perspective view of a typical L-shaped kitchen installation showing the sink unit illustrated in FIGS. 23-24 and a stove unit illustrated in FIGS. 39-39 flanked with standard cabinets, with the adjustable top of the sink and stove units in the up position.
Figure 38:
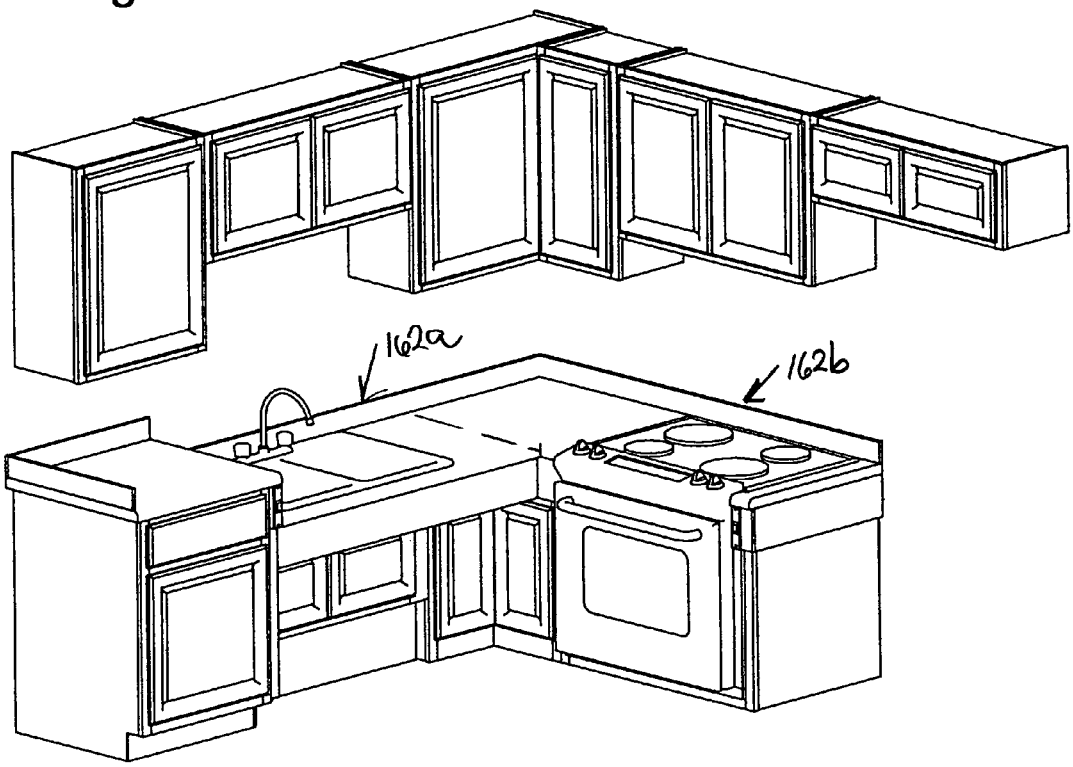
FIG. 38 is a front perspective view of the typical L-shaped kitchen installation in FIG. 37 with the adjustable tops in the down position.
Figure 39:
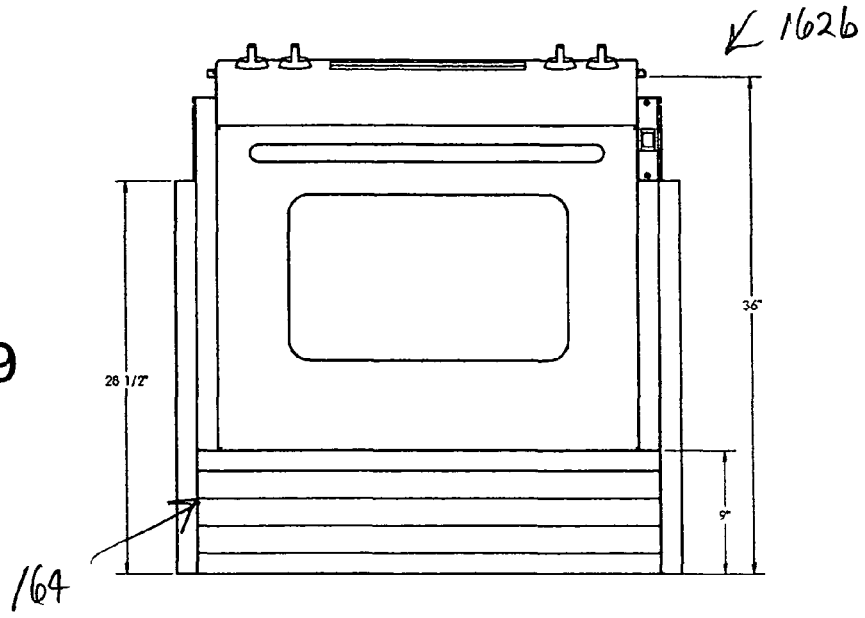
FIG. 39 is a front elevational view of a base cabinet with a stove and with an elevator unit installed shown in up position.
Figure 40:
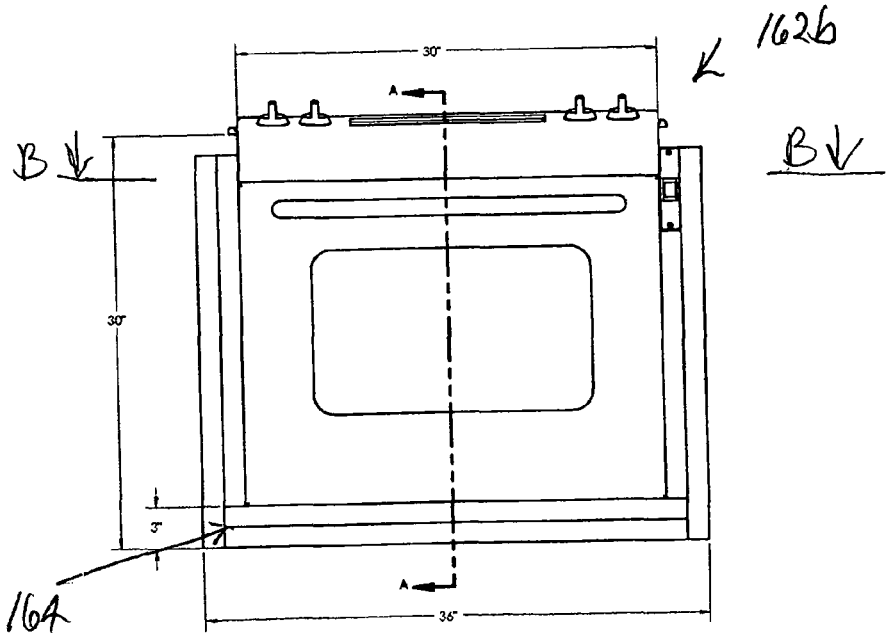
FIG. 40 is a front elevation view of the stove unit shown in FIG. 39 in the down position.
Figure 40A:
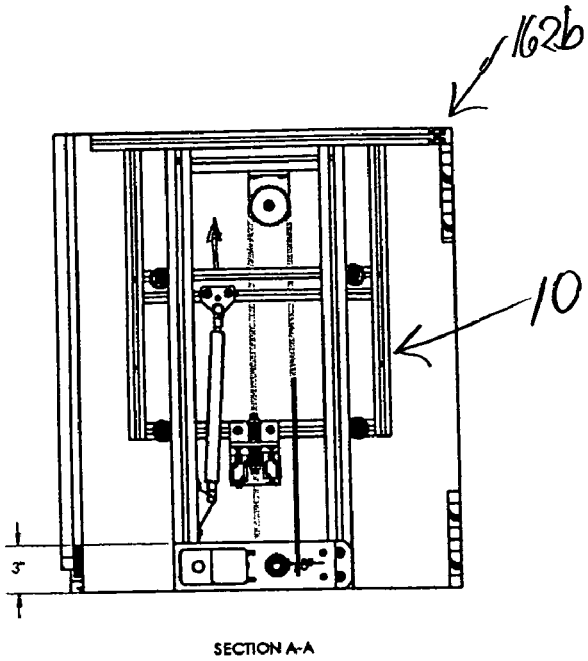
FIG. 40A is a cross section taken along line A-A in FIG. 40.
Figure 40B:
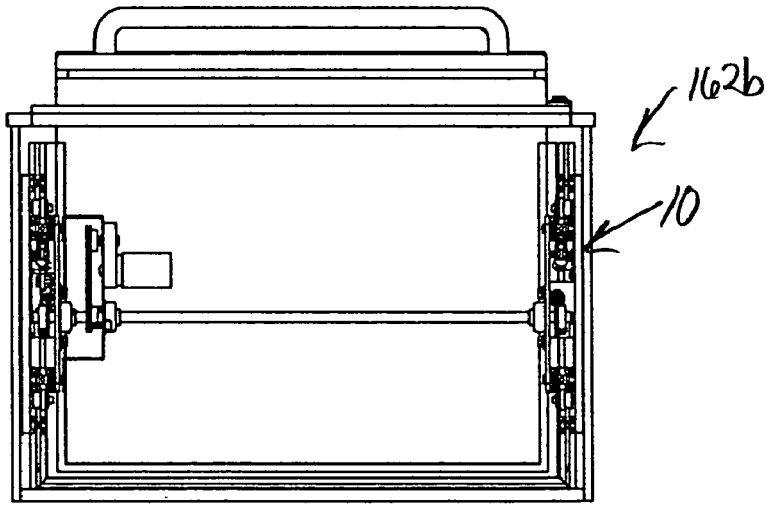
FIG. 40B is a cross section taken along line B-B in FIG. 40.
Figure 42:
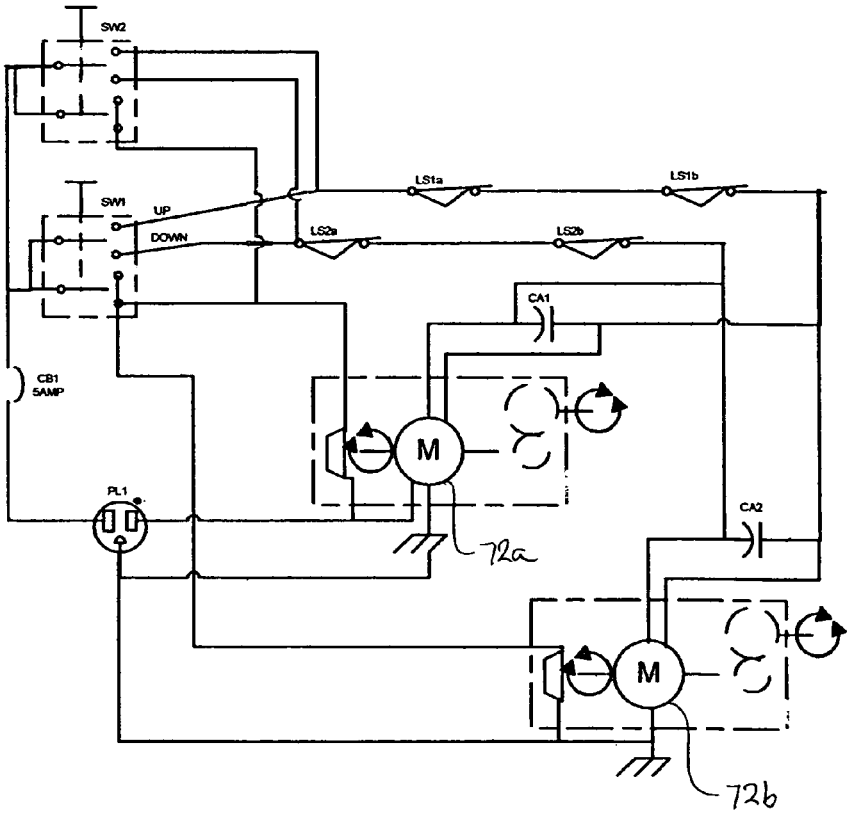
FIG. 42 is an electrical diagram showing an electrical control circuit for the drive assembly of the sink and stove units shown in FIGS. 37-38.

FIGS. 37-38 show an L-shaped kitchen layout with two base cabinet assemblies 162*a*, 162*b*, one with sink as previously described and one with a stove as shown in FIGS. 39-40. Sink base cabinet assembly 162*a* may operate separately from stove base cabinet assembly 162*b*, although they may also be made to operate in unison as shown in FIG. 42. In the circuit shown in FIG. 42, first and second motors 72*a*, 72*b* operate cabinet assemblies 162*a* and 162*b*, respectively. Cabinet assembly 162*a* is provisioned with limit switches LS1*a* and LS1*b* and cabinet assembly 162*b* has limit switches LS2*a* and LS2*b*. As shown, if any one of the limit switches is triggered in any direction, the circuit to both motors is broken.

Stove base cabinet assembly 162*b* shown in FIGS. 39-40 is similar to sink base cabinet assembly 162*a* except that in place of valance board 110, an extensible screen 164 is provided under the stove to serve as a skirt.

While the above discussion has been focused on an elevator unit with right and left elevator assemblies 12, 14, it will be understood that more than two elevator assemblies may be used when the length of movable counter top 96 or the weight to be carried justifies, there being at least one right and left elevator assembly 12, 14. It will also occur to those skilled in the art that bottom frame assembly 16 may also serve as the structural frame of cabinet 112 in which case movable top frame 18 will be on the inside of bottom frame assembly 16 and in other variations base cabinet 112 may be telescopically received within movable counter top 96 if the top is properly skirted.

Figure 41:
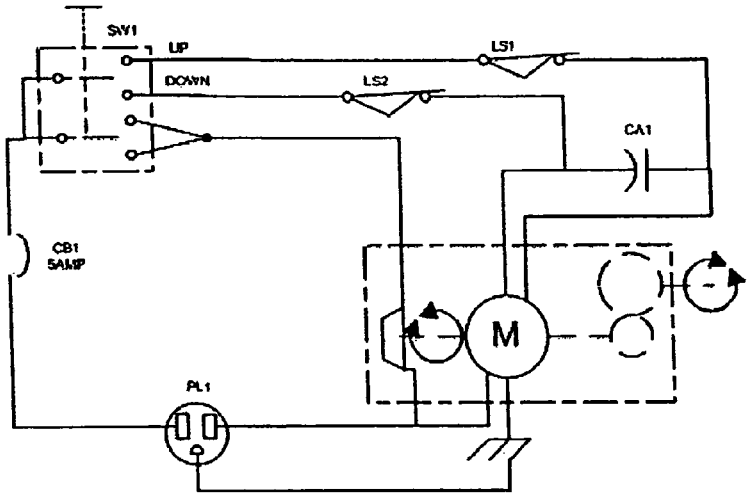
FIG. 41 is an electrical diagram showing an electrical control circuit for the drive assembly.

In use, FIG. 41 shows an electrical control circuit for operation of base cabinet assembly 122 (162*a*, 162*b*). SW1 in the drawing is the primary control switch 74 previously described which provides power to motor 72 for up or down movement. Also this switch provides power to the motor brake to disengage it during operation. LS1 and LS2 control the power input to motor 72 such that once the appropriate limit switch is tripped, power is disconnected to the motor.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An elevator unit for a work counter comprising:

a right and a left elevator assembly, a drive assembly and a motor, each said right and left elevator assembly including a top frame and a bottom frame with T-slotted vertical side rails, said bottom frame attached to a support surface, said top frame sliding vertically along said bottom frame on rollers received in the T-slots of the vertical side rails of said bottom frame;

said drive assembly including a spaced apart drive and driven pulley attached to one of said top frame and said bottom frame of each said right and left elevator assembly, said drive and driven pulley connected by a synchronous drive belt; said synchronous drive belt attached to the other of said top frame and said bottom frame of each said right and left elevator assembly, each said synchronous drive belt including compression springs to allow for misalignments between said right and left elevator assemblies; and a common drive shaft connected to the drive pulley of each of said right and left elevator assemblies;

said motor connected to the common drive shaft, whereby the top frames of said right and left elevator assemblies are raised or lowered in unison by rotation of the common drive shaft by the motor.

2. The elevator unit of claim 1 wherein the rollers are mounted on a face of the top frame and received into side edges of the bottom frame.

3. The elevator unit of claim 1 wherein a movable counter top is mounted on a rear counter top brace that joins the right and left elevator assemblies and a work counter mounting rail attached to the top frame of the right and left elevator assemblies.

4. The elevator unit of claim 1 wherein the motor is a reversible electric motor with a motor brake.

5. The base counter assembly of claim 1 wherein a counter balance is attached between the top and bottom frames of each of the right and left elevator assemblies, said counter balance sized in accordance with the weight of the movable counter and serving as a counterbalance.

6. An elevator unit for a work counter comprising: a right and a left elevator assembly, a drive assembly and a motor, each said right and left elevator assembly including a top frame and a bottom frame with T-slotted vertical side rails, said bottom frame attached to a support surface, said top frame sliding vertically along said bottom frame on rollers received in the T-slots of the vertical side rails of said bottom frame;

said drive assembly including a spaced apart drive and driven sprocket attached to one of said top frame and said bottom frame, said drive and driven sprockets connected by a roller chain drive; a first and second end of said roller chain drive joined by a connecting link received in an angle bracket on the top frame, a first compression spring attached to the roller chain drive above said bracket and a second compression spring attached to the roller chain drive below said angle bracket, first and second limit switches attached to the connecting link for detecting when travel of the elevator unit is stopped and the springs compressed by a preselected amount, said first limit switch triggered by the connecting link and stopping upward travel of the elevator unit when the first spring is compressed and said second limit switch triggered by the connecting link and stopping downward travel of the elevator unit when the second spring is compressed; and a common drive shaft connected to the drive sprocket of each of said right and left elevator assemblies;

said motor connected to the common drive shaft, whereby the top frames of said right and left elevator assemblies are raised or lowered in unison by rotation of the common drive shaft by the motor.

7. The elevator unit of claim 6 wherein the motor is a reversible electric motor with a power brake connected to a primary control switch and wherein signals from the first and second limit switches are processed by a control circuit that disengages power to the electric motor in the direction of elevator unit travel when the limit is exceeded.

8. The elevator unit of claim 7 wherein a gas compression spring is attached between the top and bottom frames of each of the right and left elevator assemblies, said gas compression spring sized in accordance with the weight of the movable counter and serving as a counter balance.

9. The elevator unit of claim 8 wherein a movable counter top is mounted on a rear counter top brace that joins the right and left elevator assemblies and on a work counter mounting rail attached to the top frame of the right and left elevator assemblies, said rear counter top brace and work counter mounting rails formed of T-slotted framing, an outer face of which includes a flexible strip for sealing the movable counter top against an adjacent stationary counter top.

10. The elevator unit of claim 8 wherein a movable counter top is mounted on a rear counter top brace that joins the right and left elevator assemblies and on a work counter mounting rail attached to the top frame of the right and left elevator assemblies, said rear counter top brace and work counter mounting rails formed of T-slotted framing, a tray with a drain mounted under the movable counter top along each of said work counter mounting rails for receiving liquids that may spill over the movable counter top.

11. A base counter assembly including a base cabinet within which is installed an elevator unit supporting a movable work counter, said elevator unit comprising: a right and a left elevator assembly, a drive assembly and a motor, each said right and left elevator assembly including a top frame and a bottom frame with vertical side rails formed of T-slotted framing, said bottom frame attached to a support surface, said top frame sliding vertically along said bottom frame on rollers received in the T-slots of the vertical side rails of said bottom frame, said movable counter top mounted on a rear counter top brace that joins the right and left elevator assemblies and a work counter mounting rail attached to the top frame of the right and left elevator assemblies;

said drive assembly including a spaced apart drive and driven sprocket attached to one of said top frame and said bottom frame, said drive and driven sprockets connected by a roller chain drive; a first and second end of said roller chain drive joined by a connecting link received in an angle bracket on the top frame, a first compression spring attached to the roller chain drive above said bracket and a second compression spring attached to the roller chain drive below said angle bracket, first and second limit switches attached to the connecting link for detecting when travel of the elevator unit is stopped and the springs compressed by a preselected amount, said first limit switch triggered by the connecting link and stopping upward travel of the elevator unit when the first spring is compressed and said second limit switch triggered by the connecting link and stopping downward travel of the elevator unit when the second spring is compressed; and a common drive shaft connected to the drive sprocket of each of said right and left elevator assemblies;

said motor connected to the common drive shaft, whereby the top frames of said right and left elevator assemblies are raised or lowered in unison by rotation of the common drive shaft by the motor.

12. The base counter assembly of claim 11 wherein a gas compression spring is attached between the top and bottom frames of each of the right and left elevator assemblies, said gas compression spring sized in accordance with the weight of the movable counter and serving as a counterbalance.

13. The base counter assembly of claim 11 wherein the motor is a reversible electric motor with a power brake connected to a primary control switch and wherein signals from the first and second limit switches are processed by a control circuit that disengages power to the electric motor in the direction of elevator unit travel when the limit is exceeded.

14. The base counter assembly of claim 13 wherein the primary control switch is housed in an interface frame forming a portion of the right or left hand side of the cabinet.

15. The base counter assembly of claim 14 wherein a second interface frame is provide on the side of the cabinet opposite the interface frame with the primary control switch.

16. The base counter assembly of claim 11 wherein a sink is mounted in the movable counter top and wherein the cabinet has a cabinet doorframe that is recessed to provide under cabinet clearance for utilization of a regular chair or clearance for a wheelchair and a toe kick in the bottom front of the cabinet with adequate height to clear foot supports on most wheelchairs.

17. The base counter assembly of claim 16 wherein a valance board is mounted to a front bottom of the movable counter top.

18. The base counter assembly of 11 wherein a stove is mounted in the movable counter top and wherein an extensible screen is mounted below the stove.

19. The base counter assembly of claim 11 comprising a first base cabinet with a sink in the movable counter top and a second base cabinet with a stove mounted in the movable counter top, each with an elevator unit.

20. The base counter assembly of claim 19 wherein each elevator unit has a reversible electric motor with a power brake, said motors synchronized and connected to a primary control switch and wherein signals from the first and second limit switches from both elevator units are processed by a control circuit that disengages power to both electric motors in the direction of elevator unit travel when the limit is exceeded by any of said limit switches.

* * * * *